US011639638B2

(12) United States Patent
Keast et al.

(10) Patent No.: US 11,639,638 B2
(45) **Date of Patent: *May 2, 2023**

(54) COMBINATION TUBULAR HANDLER AND POWER SWIVEL UNIT

(71) Applicant: Larry G. Keast, Houston, TX (US)

(72) Inventors: Larry G. Keast, Houston, TX (US); Alan Bing Joe Shem, Houston, TX (US); Jonathan Garrett Johnston, Houston, TX (US); Stephen Lee Gerhauser, Jr., Houston, TX (US); Keith J. Orgeron, Spring, TX (US)

(73) Assignee: Larry G. Keast, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,054

(22) Filed: Dec. 2, 2021

(65) Prior Publication Data

US 2022/0090453 A1 Mar. 24, 2022

Related U.S. Application Data

(63) Continuation of application No. 17/082,433, filed on Oct. 28, 2020, now Pat. No. 11,208,854, which is a continuation of application No. 16/659,033, filed on Oct. 21, 2019, now Pat. No. 10,851,601, which is a continuation-in-part of application No. 15/668,257, filed on Aug. 3, 2017, now Pat. No. 10,480,265.

(51) Int. Cl.

| | |
|---|---|
| ***E21B 19/14*** | (2006.01) |
| ***E21B 19/00*** | (2006.01) |
| *E21B 19/15* | (2006.01) |

(52) U.S. Cl.
CPC ..... *E21B 19/00* (2013.01); *E21B 19/14* (2013.01); *E21B 19/155* (2013.01)

(58) Field of Classification Search
CPC ..... E21B 19/155; E21B 3/02; E21B 19/06; E21B 19/16; E21B 19/20; E21B 19/00
See application file for complete search history.

(56) References Cited

U.S. PATENT DOCUMENTS

| | | | | |
|---|---|---|---|---|
| 2,904,310 | A * | 9/1959 | Leonard | E21B 7/023 173/159 |
| 4,255,069 | A * | 3/1981 | Yielding | E02B 17/06 405/196 |
| 4,739,868 | A | 4/1988 | Head | |
| 4,890,681 | A | 1/1990 | Skelly | |
| 6,877,942 | B2 | 4/2005 | Eastcott | |
| 7,163,367 | B2 | 1/2007 | Handley | |
| 8,387,720 | B1 | 3/2013 | Keast et al. | |
| 8,807,208 | B1 | 8/2014 | Keast | |
| 8,840,352 | B2 | 9/2014 | Taggart et al. | |
| 9,249,655 | B1 | 2/2016 | Keast et al. | |
| 9,388,647 | B2 * | 7/2016 | Dahmes | E21B 19/155 |
| 10,851,601 | B2 * | 12/2020 | Keast | E21B 19/14 |
| 11,208,854 | B2 * | 12/2021 | Keast | E21B 19/14 |

(Continued)

*Primary Examiner* — Gregory W Adams
(74) *Attorney, Agent, or Firm* — Kearney, McWilliams & Davis, PLLC; John M. DeBoer

(57) ABSTRACT

A combination unit having an extendable trough to raise a tubular to a rig floor height. There is a raising leg connected with a trough assembly, and a following leg movingly coupled with an end of the trough assembly. The unit is configured to move a power swivel or other miscellaneous tools and equipment to the rig floor without winches or cables.

18 Claims, 18 Drawing Sheets

(56) References Cited

U.S. PATENT DOCUMENTS

| | | | | |
|---|---|---|---|---|
| 2010/0163247 | A1* | 7/2010 | Wright | E21B 19/155<br>166/380 |
| 2014/0238745 | A1* | 8/2014 | Dahmes | E21B 19/15<br>175/52 |
| 2016/0060982 | A1 | 3/2016 | Layden | |
| 2016/0319612 | A1* | 11/2016 | Dahmes | E21B 19/14 |
| 2017/0198534 | A1 | 7/2017 | Folk | |

* cited by examiner

COMBINATION TUBULAR HANDLER AND POWER SWIVEL UNIT

BACKGROUND

Field of the Disclosure

This disclosure generally relates to machines, tools, systems, and the like used in the oil and gas industry for combining the functions of a pipe handler and a power swivel. More specifically, the disclosure relates to a single unit for moving individual tubulars and separately moving a power swivel and various other items or equipment to or from a rig floor.

Background of the Disclosure

When drilling for oil or gas, a wellbore is typically drilled using a drill bit attached to the lower end of a "drill string." The process of drilling a well typically includes a series of drilling, tripping, casing and cementing, and repeating as necessary. The process of doing well servicing on a previously drilled, completed, and producing well uses many of the same operations although rotation is only required for operations such as milling out a packer and/or sometimes for drilling the well deeper. FIG. 1 shows a simplified view of a conventional drilling operation 100. A derrick 102 (or drilling rig) is configured to rotate a drill string 104 that has a drill bit 106 disposed at a lower end of the drill string 104, typically using a power swivel/top drive 110 and associated equipment. The power swivel/top drive 110 rotates the string 104 and the drill bit 106 to do drilling or milling work downhole in the wellbore 108

Near the derrick 102, a plurality of tubular members 103*a* are often stored on a pipe rack(s) 112. The pipe rack 112 is relatively near the ground, and substantially below the rig floor 115. Therefore, tubulars 103, 103*a* must be transported to the rig floor 115 joint by joint for use in drilling or servicing operations.

Pipe handling systems are utilized to transport the tubular 103 from the pipe rack 112 and present the tubular 103 to rig floor 115 for use by rig floor personnel. Such pipe handling systems are commonly available from rental companies, well servicing or drilling companies, and the like. These systems are typically known as pipe handlers or hydraulic catwalks.

Before such handling equipment, handling of tubulars 103*a* has long been a problem when moving a tubular from a horizontal position on the catwalk 113, up an inclined ramp or V-door 114, to the rig floor in the derrick 102 where rig floor personnel can latch on with an elevator and raise the pipe to a vertical position. Additional men along with crude and dangerous handling procedures such as cables and winching have been required to move the tubular 103 to the angular position at the rig floor for use by rig floor personnel. Accidents and injuries have been commonplace.

Currently, many variations of pipe handling systems exist which are much safer. However, no system exists which combines the functions of a power swivel with a pipe handler. Currently, separate pipe handling and power swivel systems must be bought or rented, requiring two hauls to the rig site and taking up two equipment spaces at the rig site. The use of separate pipe handler and power swivel means twice as many service companies, twice as much equipment, twice as many people, twice as much space used, and inefficient use of rig time.

No mobile single system currently exists which may allow for coordinating the movement of a tubular to an angular presentation at a rig floor, threadably engaging the tubular at an adjustable angle with a power swivel, and for lifting the tubular to a vertical position, then rotating into the preceding joint of pipe.

Similarly, if company policy does not allow power swivel rotation into the pipe connection, this machine may be equipped with a pipe push and rotate function, which allows threadable engagement with the power swivel without power swivel rotation.

Additionally, an unsafe condition exists for moving a power swivel to a rig floor from its transport trailer. This work has been done typically by using two men and two winch lines with the power swivel in between, an obviously unsafe and dangerous condition. This combination machine easily and safely moves the power swivel from its transport position to the rig floor using the pipe handler controls and without men using winch lines.

Additionally, a need exists to store the power swivel out of the way when it is not in use. This is done with a remote-controlled hydraulic swivel rack which moves the power swivel to an out of the way position where it remains safely on its rack.

Additionally, this movable hydraulic storage rack is designed so that the power swivel always rests in the hydraulic storage rack in one of two positions when not in use on the rig. That is, in its transport position and in its storage position. When in road transport position, the arrangement allows the pipe handler to lift the power swivel up and out of the rack for easy and safe transport to the rig floor.

Additionally, a need exists for safely transporting unrelated items and equipment from the ground to the rig floor. The trough of this unit may be arranged with hooks, shackles, chain, basket, mounts, etc to allow the safe temporary attachment of such items for transport to or from the rig floor. This eliminates men carrying items up stairs and eliminates men using winches and cables. This usage also moves such items to an open space on the rig floor with out handrails in the way.

A need exists, therefore, for a combination tubular handling system and a power swivel to provide a rig site space saving solution, a rapid and safe pipe handling solution, a rapid and safe solution to transport the power swivel to and from the rig floor, a rapid and safe solution to transport various unrelated items and equipment to and from the rig floor, a power swivel tilt function allowing tilting the power swivel to a preset angle matching the pipe angle for rapid and safe spinup of the threaded connection against a soft low torque backup, and an alternate pipe rotation solution if power swivel rotation is not allowed.

The ability to increase efficiency and save operational time and expense while increasing safety leads to considerable competition in the marketplace. Achieving any ability to save time, or ultimately cost, while increasing safety leads to an immediate competitive advantage. Thus, there is a need in the art for a pipe handling system that saves time and increases safety.

SUMMARY

Embodiments of the present disclosure pertain to a combination tubular and power swivel handler, and may sometimes be referred to simply as a 'combination unit' or 'unit'. The equipment of the combination unit may be mounted on a trailer or other form of support frame, skid, chassis, etc.

Embodiments of the disclosure pertain to a combination tubular handler and power swivel unit coupled with a trailer; and a power swivel movingly disposed on the trailer. The tubular handler may have one or more of: a trough assembly; a raising leg movingly coupled with the trough assembly; and a following leg coupled with an end of the trough assembly.

The unit may have a transport mechanism configured to facilitate transfer of a tubular to the trough assembly. The transport mechanism may include one or more movable arms extending from the unit, to pick up or deliver a tubular from a pipe rack. The transport mechanism may have a pipe kicker(s) in association therewith which may be disposed in the trough assembly.

The unit may have a hose reel comprising a set of one or more hoses; an engine, and a pump(s) disposed on the trailer. One or more of the hoses may be in fluid communication with the pumps and the power swivel. The trough assembly may be configured to lift the power swivel off the swivel rack of the trailer for separate delivery of both the power swivel and at least one tubular to a height. In aspects, the height may be in a height range between and including 4 feet to 100 feet.

The main lifting arm may include a trough housing with a first slider coupled with a first housing side of the trough housing, and a second slider coupled with a second housing side of the trough housing. The raising leg may have a first leg guide rail movingly engaged with the first slider. The raising leg may have a second leg guide rail movingly engaged with the second slider. The raising leg may have an at least one row of selector holes proximately disposed in either of the first leg guide rail or the second leg guide rail.

The support frame may have a power swivel support rack configured to move from a raised transport position to a lowered storage position. The combination unit may have an at least one operator station operably configured to control an at least one of the tubular handler, the power swivel, and combinations thereof.

The raising leg may be configured to move in a raising leg angle range between and including 0 degrees to 175 degrees. The trough assembly may include a skate configured with a platform for resting an end of a tubular thereon. A portion of the skate (or the platform) may be configured to push and rotate the tubular as it sits in the trough assembly. In aspects, the trough assembly may be configured to grip and/or rotate the tubular.

Embodiments of the unit may be provided to push and rotate the tubular as it sits in the trough assembly.

The unit may include an at least one fluid source or reservoir disposed on the support frame and in fluid communication with each of the pump and the power swivel.

Other embodiments of the disclosure pertain to a drilling system that may include a derrick, mast, or other comparable structure. The derrick may have a rig floor elevated to a height from ground level. The height may be between and including 5 feet and 100 feet.

There may be a tubular source proximate to the derrick, and comprising an at least one tubular. The source may be a pipe rack having the at least one tubular thereon.

The system may include a combination unit having a trailer or support frame; a power swivel movingly disposed on the trailer; and a tubular handler coupled with the trailer. The tubular handler may include a trough assembly; and a raising leg movingly coupled with the trough assembly. The tubular handler may have a following leg pivotably coupled with an end of the trough assembly.

The combination unit may include a transport mechanism configured to facilitate transfer of the at least one tubular to the trough assembly from the tubular source. The unit may have a hose reel comprising a plurality of hoses. There may be an engine and pumps disposed on the trailer or support frame.

The trough assembly may be configured to lift the power swivel off the swivel support rack of the trailer or support frame for delivery of the power swivel to the rig floor.

The trough assembly may include a main lifting arm having a first end configured for a trough to extend therefrom. The tubular may lay or otherwise be disposed within the trough. The end of the lifting arm assembly may include a second end of the trough.

The trough assembly may include a trough housing with a first slider coupled with a first housing side of the trough housing. The main trough may include a second slider coupled with a second housing side of the trough housing. The raising leg may include a first leg guide rail movingly engaged with the first slider. The raising leg may include a second leg guide rail movingly engaged with the second slider.

The support frame may include a powered support rack for a power swivel configured to move from a lowered position to a raised position, and from the raised position to the lowered position. The trailer or support frame may include a gooseneck trailer hitch. The engine and pump(s) may be disposed on the gooseneck.

The unit may include an at least one fluid source disposed on the support frame and in fluid communication with each of the pump and the power swivel. In aspects, the hose reel may be disposed on the support frame and underneath the first end of the trough assembly (e.g., when the trough assembly is in its lowered position).

Embodiments of the present disclosure pertain to a combination tubular and power swivel handler, and may sometimes be referred to simply as a 'combination unit' or 'unit'. The equipment of the combination unit may be mounted on a platform (or other form of support frame, chassis, etc.), which may be in the form of a trailer or a skid.

The tubular may be a pipe, and the power swivel may be any form of driver or power rotation device. In an alternative to handling the power swivel, the combination unit may be used to handle other components, such as tools or other pieces of equipment.

The support frame may be in the form of a trailer or a skid. The support frame may be configured to be towed by a vehicle, and may have wheels, outriggers, and a towing hitch. The outriggers may be configured to be retracted or extended as necessary. When the support frame is positioned as desired, the outriggers may be extended to secure the unit in a level and substantially fixed position.

The combination unit may have or include a power swivel, a transfer mechanism, a tubular handler, and an operator station(s) for controlling one or more of the tubular handler, the power swivel, and the transfer mechanism. In embodiments, the power swivel may have a tilt function or mechanism with adjustable maximum and minimum tilt positions.

The combination unit may thus have the tubular handler and the power swivel together on a single trailer or support frame, and thereby may only require or utilize a single footprint near the rig (saving valuable space).

Automation of repetitive tasks with this handler may provide rapid and safe presentation of tubulars to the rig floor which minimizes the need for personnel to have "hands on" equipment or tubulars, thus increasing the safety of operations. Further, the flexibility of being able to use either the tubular handler or the power swivel, or both together, may improve equipment utilization rates, improve safety, and save time, and therefore reduce overall cost, and increase profitability for users (such as rental or service companies).

The power swivel may be movingly disposed on a power swivel support rack. The power swivel support rack may be configured to have the power swivel thereon during travel to a rig site.

In embodiments, the power swivel may be in fluid communication (directly or indirectly) with a hose reel and a pump(s) for fluid supply. The hose reel may have a plurality of hoses in fluid communication with a hydraulic pump(s). The plurality of hoses may include two main power hoses, one case drain hose, and one pressure hose (for the tilt cylinder). The plurality of hoses may be extended and retracted (unrolled and rolled up) from the hose reel. The tilt cylinder, like any double acting hydraulic cylinder, may utilize two hoses for powering to extend and retract. Alternatively there may be circuit that uses a hose or tube onboard the power swivel in communication with a low pressure hydraulic fluid source configured to tilt the power swivel back to vertical.

There may be a power swivel control panel for remotely controlling the power swivel (including the tilt function) from the unit. In embodiments, the power swivel control panel may be relocated to the rig floor where the rig operator may conveniently and safely control the power swivel.

Tubular handling functions provided via the combination unit may include one or more of the following, but are not limited to the following: a transfer mechanism may be provided to transfer the tubular to and from a tubular source, such as a pipe rack; tubular loading arms may be arranged to support transfer of the tubular on a slight grade toward or away from a trough assembly; an indexing mechanism may be arranged to index one tubular at a time into the pipe handler trough while holding back the other joints; a trough assembly may be configured to raise and lower a tubular to a desired position; a skate may be powered (e.g., hydraulically) to push a tubular or a joint of pipe up the trough to a convenient extension for use by rig floor personnel, where the tubular may be threadably engaged by the power swivel.

Alternatively the pipe may be rotatable by the skate and/or trough assembly to threadably engage the non-rotating power swivel.

Still other embodiments pertain to a combination tubular handler and power swivel unit that may include any of: a support frame; a power swivel movingly disposed on the support frame; a tubular handler coupled with the support frame; and a transport mechanism configured to facilitate transfer of an at least one tubular to the trough assembly.

The tubular handler may include a trough assembly. The trough assembly may include a main trough having a first end configured for a secondary trough to extend therefrom; and a skate configured with a platform for resting an end of a tubular thereon.

There may be a raising leg movingly coupled with the trough assembly, the raising leg configured with a first guide rail. There may be a following leg pivotably coupled with an end of the trough assembly. There may be a transport mechanism configured to facilitate transfer of an at least one tubular to the trough assembly.

The trough assembly may be configured to lift the power swivel for delivery of the power swivel a height. An underside of the main trough may be configured with a trough housing.

Embodiments herein pertain to a method of using a combination tubular and power swivel handling unit. The method may include one or more steps discussed herein, and need not be in any specific order. The method may include the step of providing a combination unit proximate a drilling or service rig. The combination unit may be any of the embodiments described herein or as otherwise claimed. The combination unit may be towed to a rig site with a vehicle, and may be positioned as desired near a source of tubulars.

The method may include the step of securing the combination unit to be substantially level and stationary with a plurality of outriggers. Outriggers may be configured to be extended or retracted as needed by various known means. The method may include the step of raising the power swivel for engagement by an elevator suspended from a traveling block of the rig. In aspects, the method may include using the combination unit to raise the power swivel unit to the drilling rig floor for attachment to the traveling block.

There may be cabling, hoses, and the like on the combination unit and attached to the power swivel. There may be a drawworks, cable, elevator, and traveling block on the rig, which may also be attached to the power swivel. In aspects, the power swivel may be attached to the end of the tubular handler and transported thereby to the rig floor for attachment to the elevator and traveling block.

The method may include the step of transferring the tubular via the transfer mechanism to the tubular handler. In embodiments, the transfer mechanism may include a plurality of powered arms, which may be positional to have a slight grade toward or away from the tubular handler (to facilitate movement of tubulars via gravity). The combination unit may include a kicker or indexing mechanism. The tubular handler may include a trough assembly configured to receive the tubular.

The method may include the step of presenting the tubular to the rig floor using the tubular handler. The tubular handler may be operable to raise the trough assembly and push the tubular therefrom until the tubular is presented at a desired angle, a desired height, and a desired extension at the rig floor. The tubular handler may be operable to receive the tubular or the power swivel from the rig floor, and lower the trough assembly to a level position.

The method may include the step of threadably engaging the tubular with the power swivel (e.g., upon delivery to the rig floor). Upon presentation of the tubular, the power swivel may be used to threadably engage the tubular and lift it safely and rapidly to a vertical position, ready for drilling.

Alternatively, the method may include the trough having the ability to rotate the pipe onto the thread of the tilted non-rotating power swivel.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
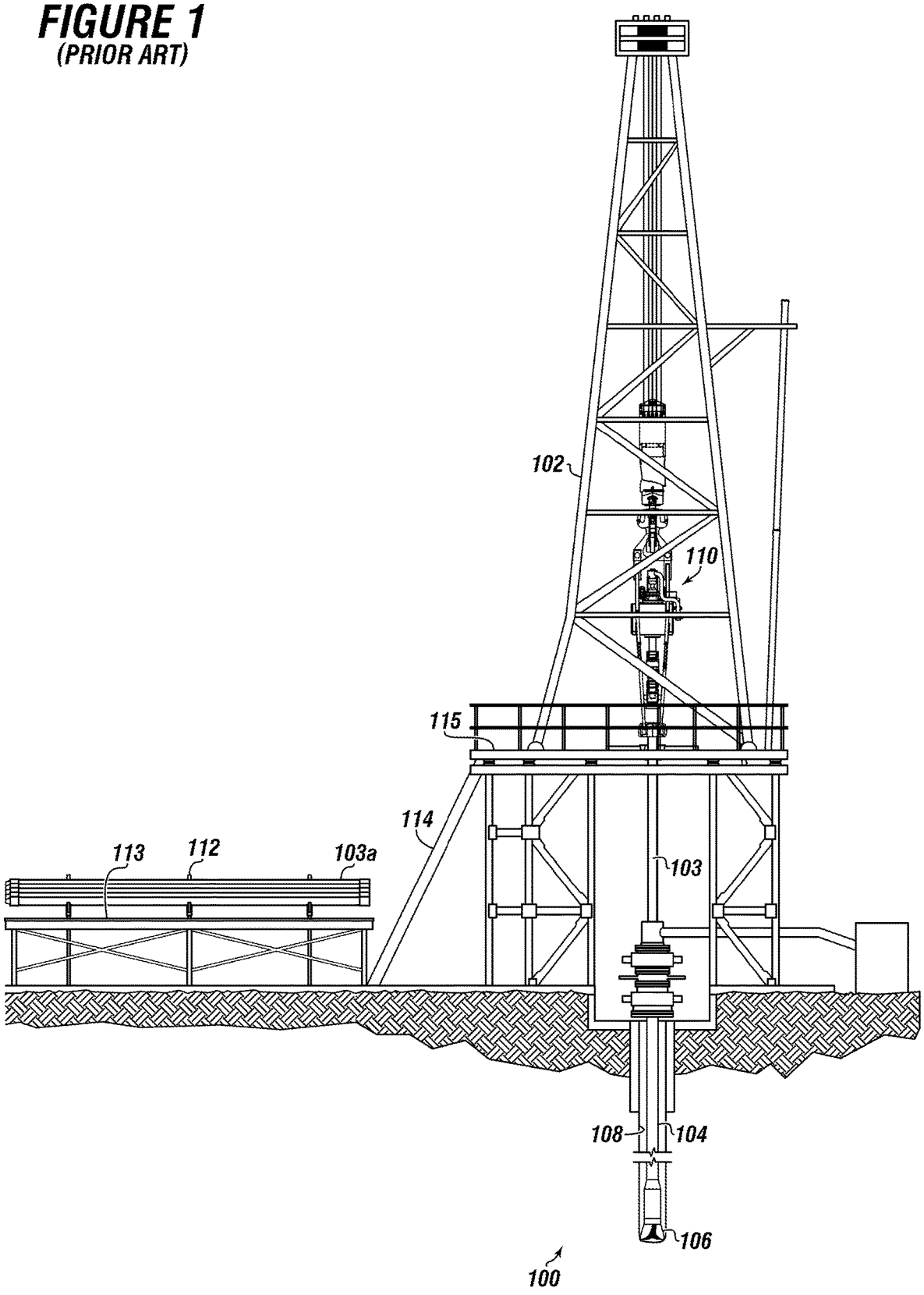
FIGURE 1 (PRIOR ART)
FIG. 1 is a side view of a process diagram of a conventional drilling operation for an oil and gas production system.
Figure 2A:
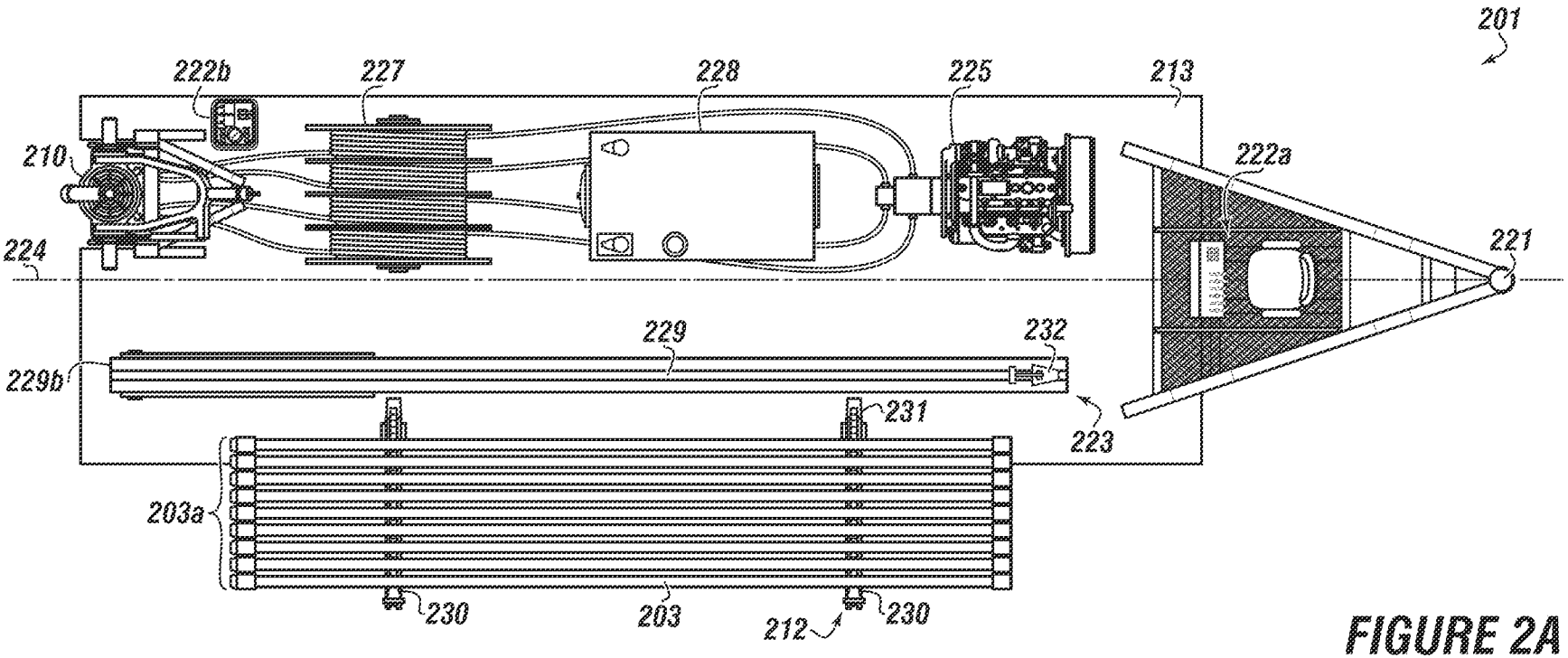
FIG. 2A shows a top view of a combination hydraulic catwalk and power swivel according to embodiments of the disclosure.
Figure 2B:
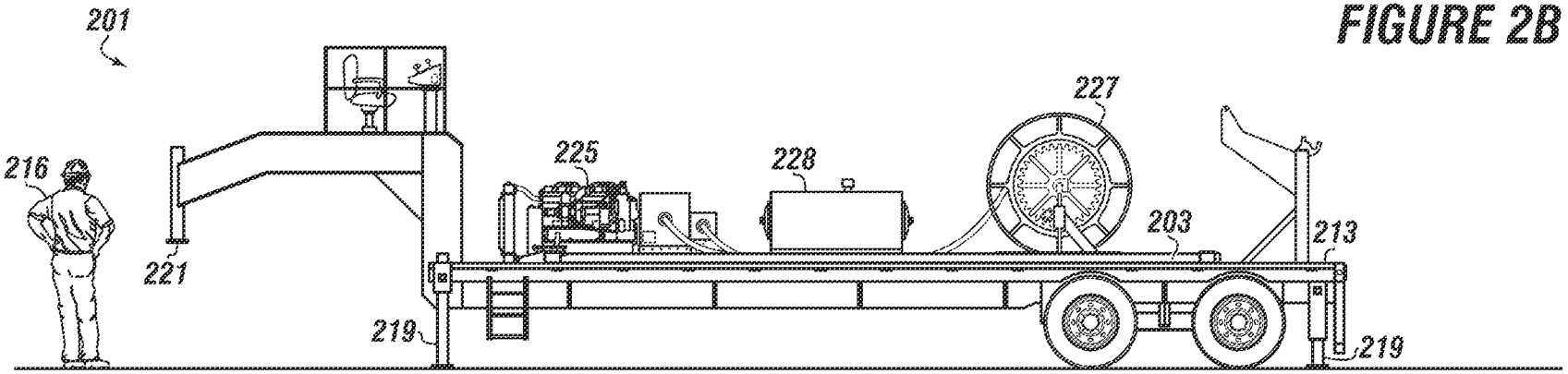
FIG. 2B shows a side view of the combination hydraulic catwalk and power swivel according to embodiments of the disclosure.
Figure 2C:
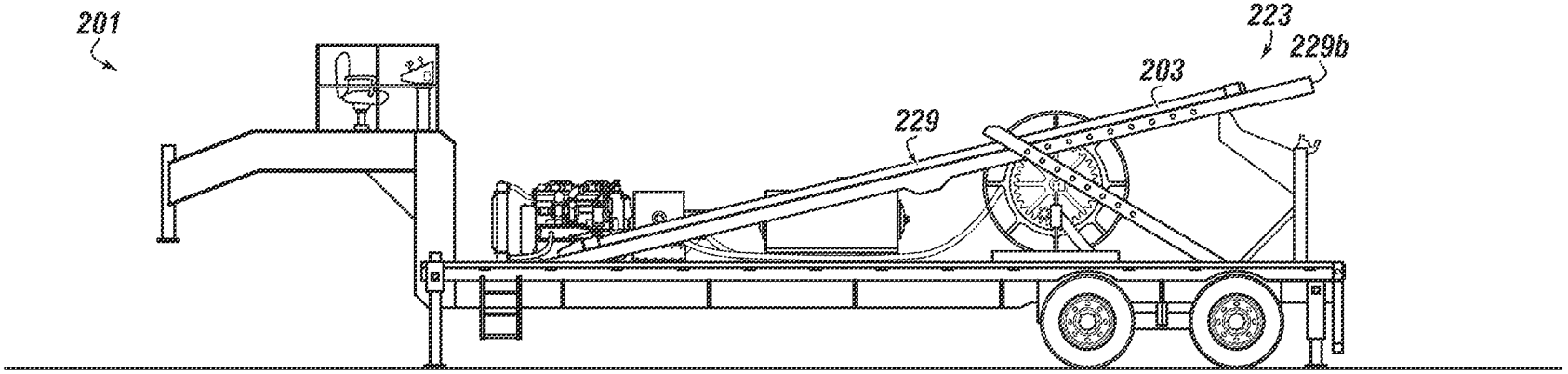
FIG. 2C shows a side view of the combination hydraulic catwalk and power swivel with the hydraulic catwalk partially raised according to embodiments of the disclosure.
Figure 2D:
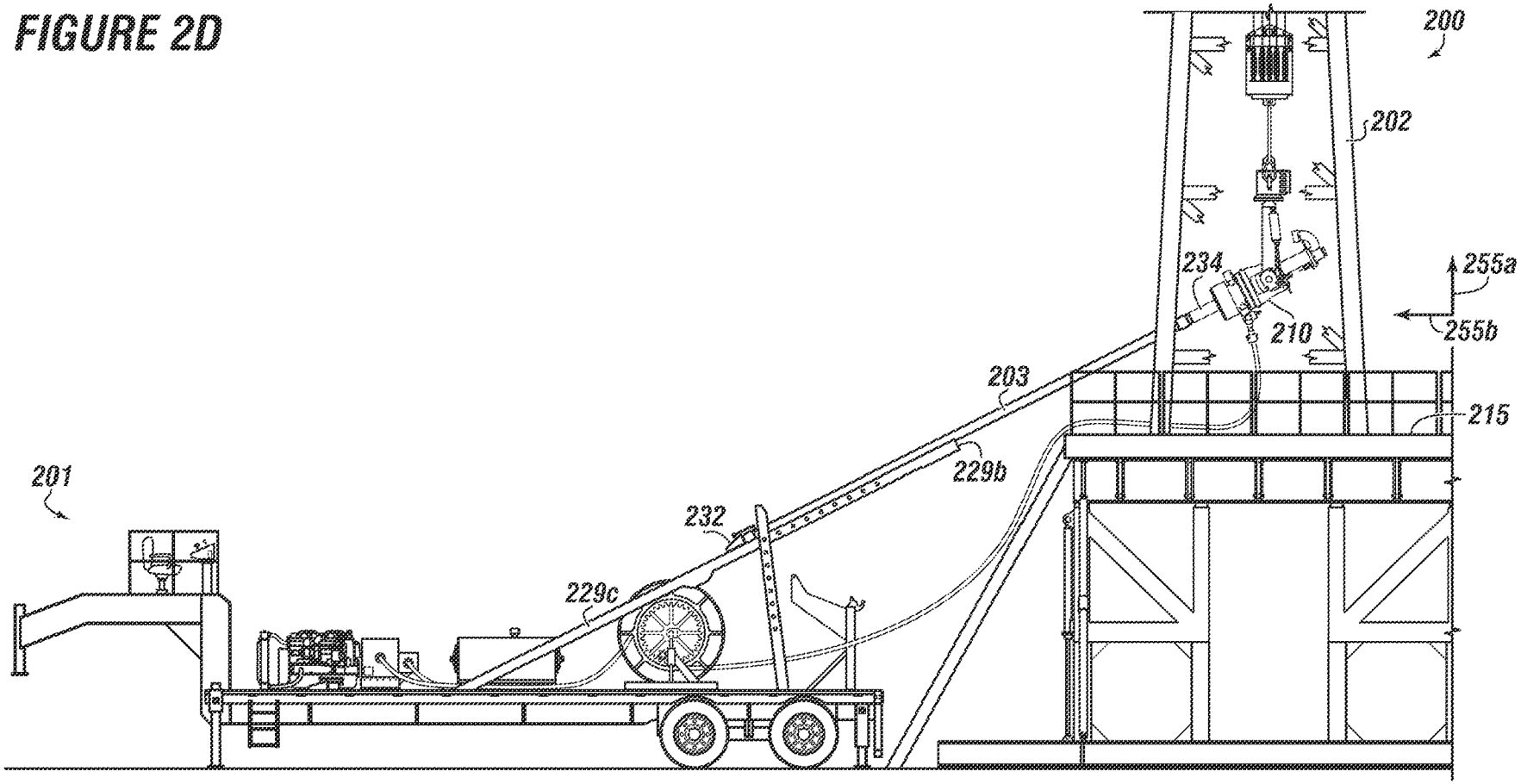
FIG. 2D shows a side view of the combination hydraulic catwalk and power swivel with the hydraulic catwalk presenting a tubular to a platform according to embodiments of the disclosure.

Regardless of whether presently claimed herein or in another application related to or from this application, herein disclosed are novel apparatuses, units, systems, and methods that pertain to improved handling of tubulars, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may (but need not) be tubular in nature.

The term "composition" or "composition of matter" as used herein may refer to one or more ingredients, components, constituents, etc. that make up a material (or material of construction). Composition may refer to a flow stream of one or more chemical components.

The term "skid" as used herein may refer to one or more pieces of equipment operable together for a particular purpose. For example, a 'catwalk-power swivel skid' may refer to one or more pieces of equipment operable together to provide or facilitate presenting a tubular to a derrick. A skid may be mobile, portable, or fixed. Although 'skid' may refer to a modular arrangement of equipment, as used herein may be mentioned merely for a matter of brevity and simple reference, with no limitation meant. Thus, skid may be comparable or analogous to zone, system, subsystem, and so forth.

The term "skid mounted" as used herein may refer to one or more pieces operable together for a particular purpose that may be associated with a frame- or skid-type structure. Such a structure may be portable or fixed.

The term "engine" as used herein may refer to a machine with moving parts that converts power into motion, such as rotary motion. The engine may be powered by a source, such as internal combustion.

The term "motor" as used herein may be analogous to engine. The motor may be powered by a source, such as electricity, pneumatic, or hydraulic.

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' may further include reference to a driver, such as an engine and drive shaft. Types of pumps include gas powered, hydraulic, pneumatic, and electrical.

The term "utility fluid" as used herein may refer to a fluid used in connection with the operation of a heat generating device, such as a lubricant or water. The utility fluid may be for heating, cooling, lubricating, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "power swivel" as used herein may refer to a type of equipment used on a service rig or drilling rig, mainly to facilitate rotational operations. A power swivel may be powered, such as hydraulically or electrically, for handling or rotating tubulars, and may also act as a channel for drilling fluid. It also supports the weight of the drill string of pipe safely over men's heads. as used herein may refer to any driver machine or device suitable and known to one of ordinary skill in the art to impart work, typically in the form of suspending and rotating pipe. A power swivel or a top drive is an example of such a driver. A power swivel known to one of skill as being an alternative to and different from a rotary table.

The term "tubular handler" as used herein may refer to a mechanism, assembly, system, combination of equipment, and so forth for handling a pipe. For example, a tubular handler may have an elevator with an inclined ramp, and a chain drive skate mechanism designed to raise or lower a tubular.

The term "handling", "handle", "handler", and the like, as used herein may refer to use of a machine (or a unit having a combination of machines, components, parts, etc.) to handle, move, deliver, present, transport, convey, etc. an object. For example, the combination unit of the present disclosure may handle a tubular, which may encompass the loading of the tubular into the unit, and then delivery of the tubular to a destination (such as a derrick for use in a workstring). The opposite may also be included. For example, the tubular may be removed from the workstring and loaded onto the unit from a rig floor, lowered to ground level, and delivered back to a tubular source.

The term "transfer mechanism" as used herein may refer to a mechanism for moving an object from a first position, such as a source, to a second position, such as within the combination unit.

Referring now to FIGS. 2A-2D together, a top view of a combination hydraulic catwalk and power swivel; a side view of the combination hydraulic catwalk and power swivel; a side view of the combination hydraulic catwalk and power swivel with the hydraulic catwalk partially raised according to embodiments of the disclosure; and a side view of the combination hydraulic catwalk and power swivel with the hydraulic catwalk presenting a tubular to a platform according to embodiments of the disclosure, illustrative of embodiments disclosed herein, are shown.

FIGS. 2A-2D show a drilling operation 200 that utilizes a combination unit 201 that may be configured with a platform or other form of support structure 213 with various components attached thereon, including for transport. The platform 213 may be a trailer or a skid system configured to be towed or otherwise transported to a site for use. The unit 201 may have a tow hitch 221 or comparable form of coupler, which may be configured to facilitate transport or moving. The platform 213 may be configured with one or more outriggers or legs 219, which may help secure or hold the unit 201 in a substantially immovable fashion.

The combination unit 201 may have a power swivel 210 and associated components. The power swivel 210 may be (movingly) located on one side of a center (axis) line 224 of the platform 213. Associated components may include a hose reel 227, a hydraulic fluid tank 228, and a pump and engine 225. In embodiments, a power swivel operator station 222*b* may be detachably secured to the platform 213. The power swivel operator station 222*b* may be placed adjacent a rig operator station (not shown here) to allow a rig personnel (such as an operator, e.g., 216) to control the power swivel 210.

In embodiments, the unit 201 may have an operator station 222*a* for operating a pipe handling system 223. The pipe handler 223 and a pipe loader 212 may be secured to or otherwise coupled with the unit 201. The handler 223 and/or the pipe loader 212 may be disposed opposite centerline 208 from the power swivel 210 and associated components. In embodiments, the pipe loader 212 may include one or more pipe support arms 230 that extend(s) outward from the platform 213. The pipe support arms 230 may have a slight grade to allow tubulars 203 to roll toward a trough 229. The pipe loader 212 may include a pipe indexing mechanism 231 to index one tubular 203 (of a plurality of tubulars 203*a*) at a time into the trough 229.

The trough 229 may be a v-shaped structure to center the tubular 203. The trough 229 may have a pusher or skate 232 operatively and movingly associated therewith. As such, the skate 232 may be operable to push the tubular 203, or a portion of the trough 229 in order to present the tubular 203 to the rig floor 215 (or the proximate area of the system 200 to which the tube string may be made up).

The pipe handler 223 may be configured with a mechanism or other suitable configuration to lift the trough 229 (or an end of the trough 229*a*) to present or bring the tubular 203 to the drilling rig 202. The pipe handler may also or alternatively include a mechanism to lift the trough 229 (or end 229*b*) in order to adjust an angle of presentation of the tubular 203. When presented to the rig 202 (or rig floor 215), the tubular 203 may be engaged (e.g., threadingly) by the power swivel 210, lifted off the trough 229, and then moved to a vertical position for engagement (making up) with another tubular (not shown here). The tubular 203 and/or power swivel 210 may be presented or otherwise positioned at an angle (with respect to a reference axis, such as a vertical 255*a* or a horizontal 255*b*).

The trough 229 may have a first end 229*b* and a second end 229*c*, with the first end 229*b* being most proximate to the rig 202. The trough 229 may have the trough end 229*b* partially or completely raised. The other end 229*c* of the trough 229 may also be raised.

The power swivel 210 may be operatively attached to a traveling block of the rig 202. The pusher or skate 232 may extend or otherwise move the tubular 203 and present it to the rig 202. The power swivel 210 may have a stem 234 for threadably engaging the tubular 203. The traveling block of the rig 202 may then be raised to lift the tubular 203.

Figure 3A:
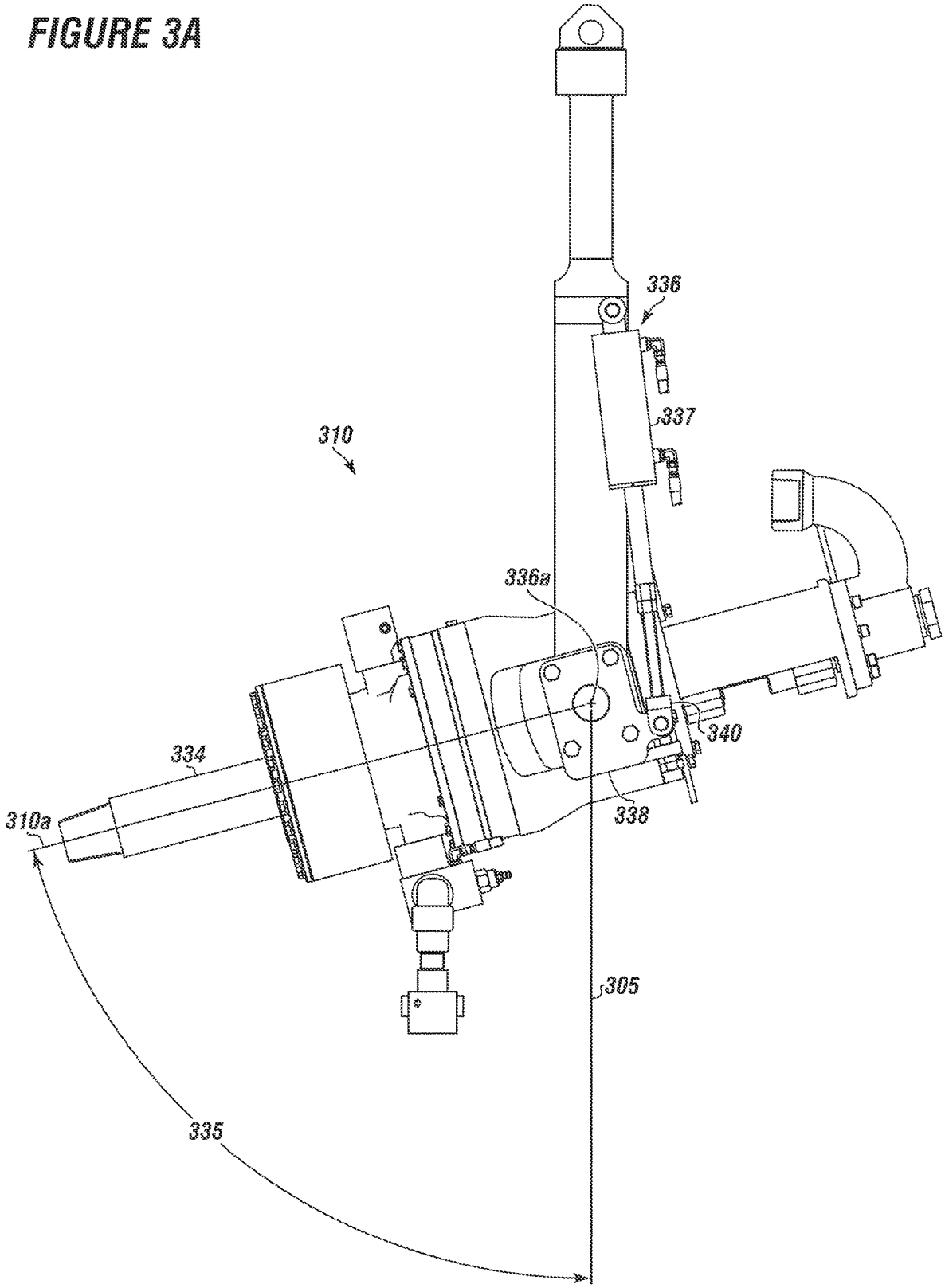
FIG. 3A shows a side view of the power swivel tilted away from a substantially vertical position according to embodiments of the disclosure.
Figure 3B:
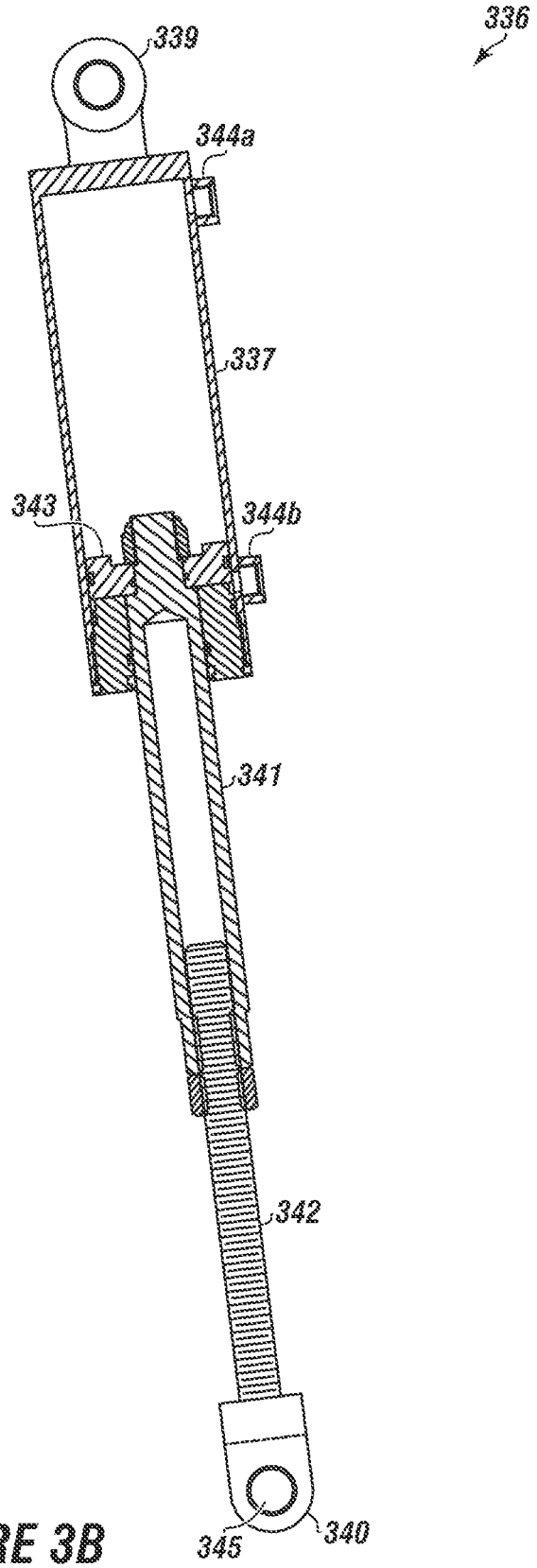
FIG. 3B shows a side cross-sectional view of a tilt cylinder assembly according to embodiments of the disclosure.

Referring now to FIGS. 3A-3B together, a side view of a power swivel tilted away from a vertical orientation, and a side cross-sectional view of a tilt cylinder assembly usable with the power swivel of FIG. 3A, illustrative of embodiments disclosed herein, are shown.

FIGS. 3A-3B show a power swivel 310 may have a tilt cylinder assembly 336 configured to extend a cylinder 337 (via piston 343). The power swivel 310 may have a normal or vertical orientation, which is typically the orientation for making up a tubular connection. Thus, the power swivel 310 may have a swivel axis 305 parallel to a vertical or other reference axis (255*a*, FIG. 2D).

However, the power swivel 310 may tilt away from a vertical position, including its full range of motion or extension from the cylinder 337. When the cylinder 337 retracts (via motion of piston 343), the power swivel 310 may be rotated toward a vertical position to be repositioned at a desired vertical angle. The tilt cylinder assembly 336 may control tilting of the power swivel 310 about a center point 336*a* to a tilt angle 335. The full extension of the cylinder 337 may be adjusted to control the tilt angle 335. In embodiments, the tilt angle 335 may be a preset tilt angle. The power swivel may have a power swivel axis 310*a*. The tilt angle 335 may be the amount of angle between an original reference axis 305 and a range of movement of a stem 334.

The assembly 336 may include a tilt plate 338 that may further include a tilt plate clevis 340. In embodiments the cylinder 337 of the assembly 336 may be hydraulic. In this respect, the cylinder 337 on one end may include a piston rod 341.

Extension of the tilt cylinder assembly 336 may be adjusted by using a threaded rod 342 coupled with the piston rod 341. The threaded rod 342 may be engaged (such as threadingly) with the piston rod 341, which may be extended and retracted via the cylinder 337. The full rotational range may be adjusted by manipulating the extended length of the threaded rod 342.

The threaded rod 342 may adjustably extend from the cylinder 337, in that the threaded rod 342 may be threaded into or out of the cylinder 337, as the threads may engage the piston rod 341. As such, the tilt cylinder assembly 336 may operate to tilt the power swivel 310. In embodiments, the tilt cylinder assembly 336 may engage a connecting means on a side opposite the tilt plate 338. The threaded rod 342 may adjust various distances into and away from the piston rod 341, thus adjusting the maximum tilt angle. The cylinder piston 343 may be disposed in the cylinder 337, and may be connected to the piston rod 341. The cylinder piston 343 may be used to extend or retract the piston rod 341.

The tilt cylinder assembly 336 may include a cylinder attachment 339, such as a bail attachment clevis, may connect the cylinder 337 to the connecting means. The cylinder may include one or more ports coupled with a fluid source. For example, there may be an extend or inlet port 344*a* for receiving a utility fluid into the cylinder 337, allowing the fluid to act on and move the piston 343 to extend the piston rod 341. The cylinder 337 may also have a retract port 344*b* for receiving fluid into the cylinder 337 on an opposite side of the piston 343, whereby the fluid may push on the piston 343 in an opposite direction, and thus the piston rod 341 may retract into the cylinder 337, at least in part.

The tilt cylinder assembly 336 may include a tilt plate clevis 340, which may be secured to the threaded rod 343, opposite the cylinder 337. The tilt plate clevis 340 may couple the tilt plate 338 with the assembly 336. There may be a pin 345 configured to secure the tilt plate clevis 340 movably to the tilt plate 338.

In embodiments, a pneumatic remote control panel may be used and may contain meters and gauges for operating the power swivel on the rig. The pneumatic remote control panel may control power swivel tilting while keeping the operator a safe distance from the power swivel's moving components.

Figure 4A:
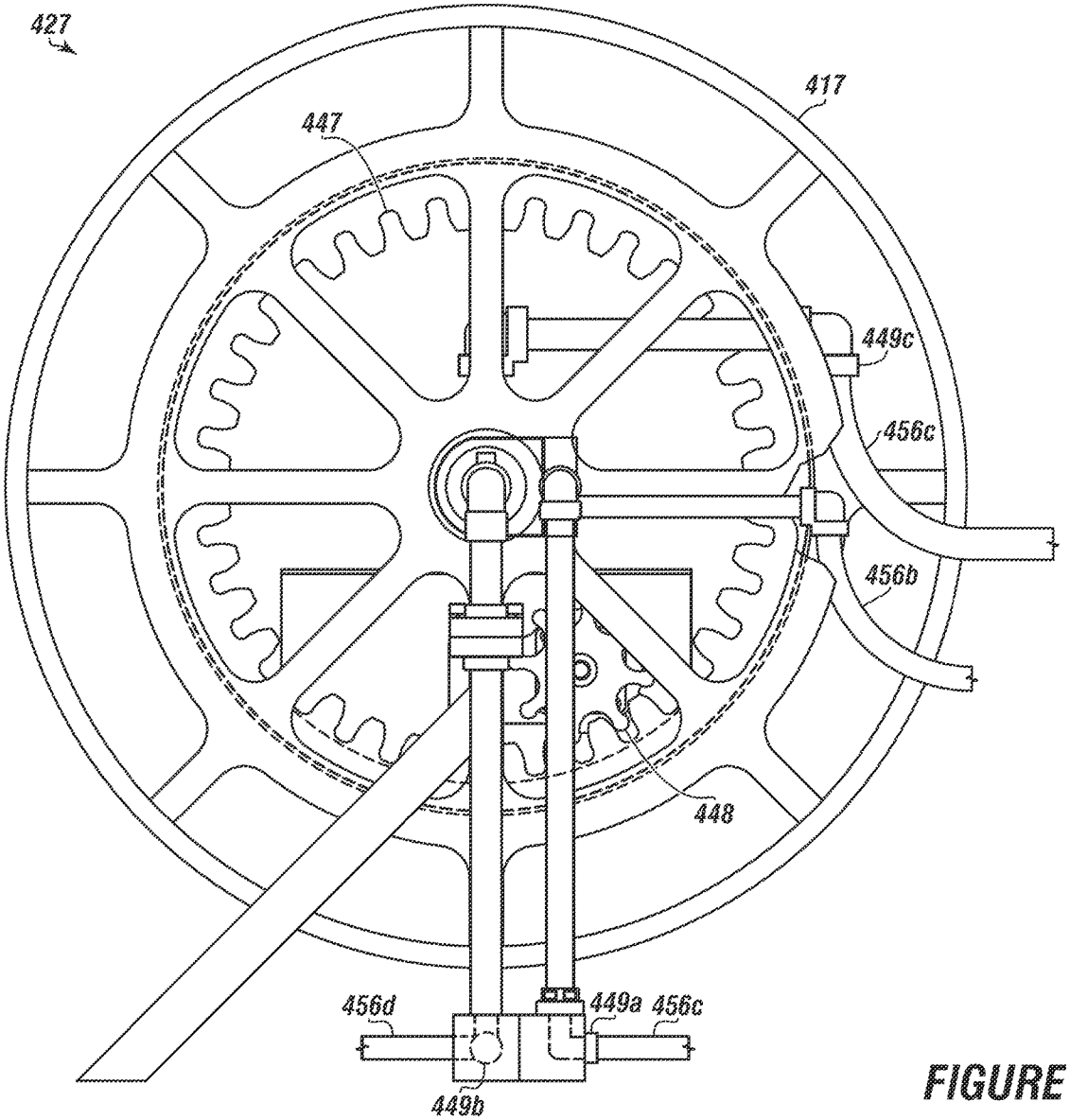
FIG. 4A shows a side view of a hydraulic hose reel assembly according to embodiments of the disclosure.
Figure 4B:
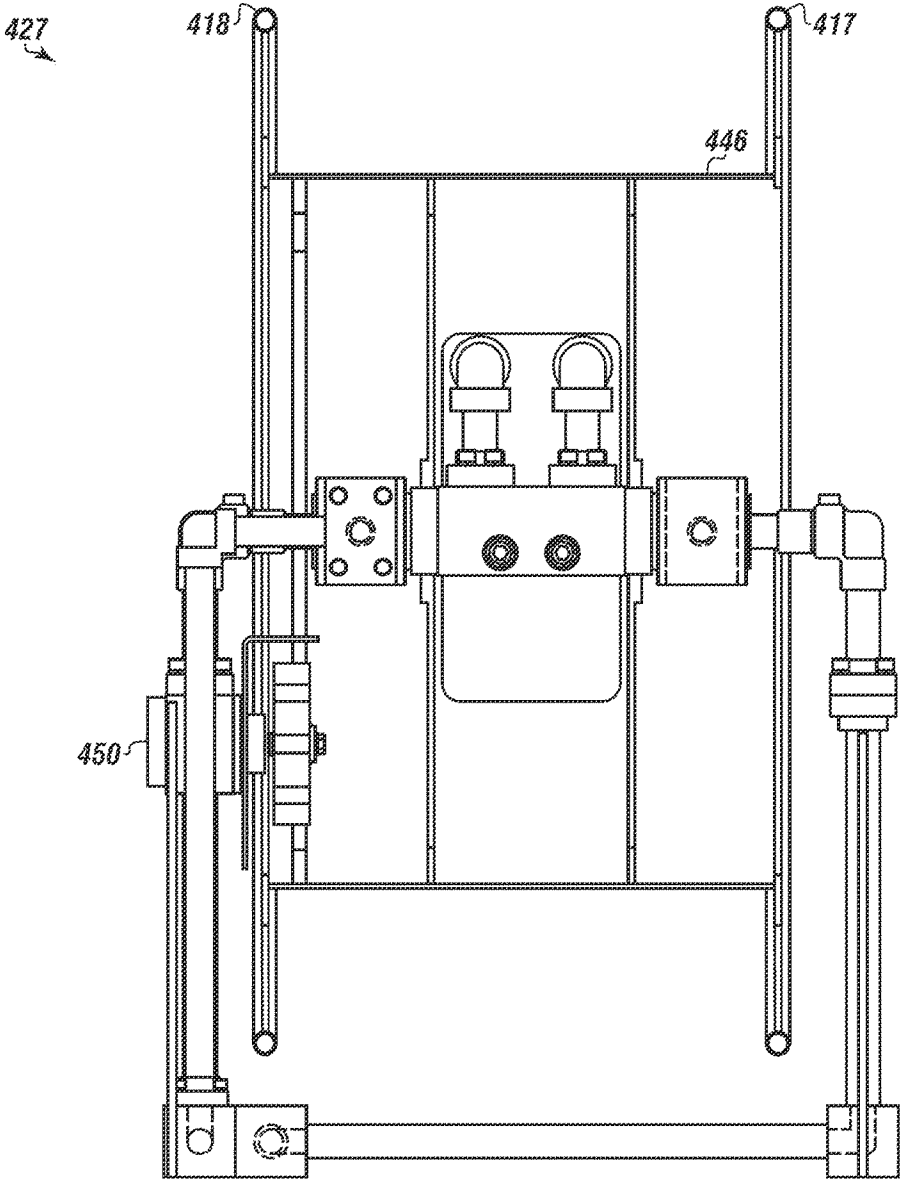
FIG. 4B shows a rotated view of the hydraulic hose reel assembly according to embodiments of the disclosure.

Referring now to FIGS. 4A and 4B together, a side view of a hydraulic hose reel assembly, and a rotated view of the hydraulic hose reel assembly of FIG. 4A, illustrative of embodiments disclosed herein, are shown.

FIGS. 4A-4B show the hose reel 427 may be hydraulic whereby the hose reel is coupled or in fluid communication with (directly or indirectly) a (hydraulic) fluid source (not shown here) (and/or other sources, such as an oil tank), and configured to provide or otherwise distribute the fluid to other components in fluid communication therewith. The reel 427 may have a first wheel 417, a second wheel 418, a drum 446 (which may be mounted between the wheels 417, 418), a ring gear 447 secured to the drum 446, a pinion gear 448 (which may be coupled with the ring gear 447), and a reel drive motor 450 (which may be connected to the pinion gear 448). The reel 427 may include a plurality of ports, such as ports 449 *a, b, c* configured for the flow of fluid therethrough.

In embodiments, the drive motor 450 may operably connect to the pinion gear 448, thereby rotating the pinion 448 engaging with the ring gear 447, and thereby rotating the wheels 417, 418 and drum 446.

The hose reel assembly 427 may include a plurality of fluid flow pathways. In embodiments, a power swivel (e.g., 210) may utilize a novel fluid flow path or circuit to retract to a vertical position, which may reduce the number of needed hoses from five in a typical installation, to four, thus simplifying the reel arrangement.

The hose reel 427 may have a plurality of hoses therewith, which may be coupled with a fluid source(s), other components, and so forth, whereby fluid flow may be provided thereby to anything in fluid communication with the hose reel 427. There may be a first hose 456*a* and a second hose 456*b* in fluid communication with a rotational mechanism such as a hydraulic motor of a component coupled therewith, such as the power swivel. There may be a third hose 456*c* in fluid communication with a drain of the rotational mechanism of the component, as well as a fourth hose 456*d* in fluid communication with the component for supplying fluid to tilt the component.

Figure 5A:
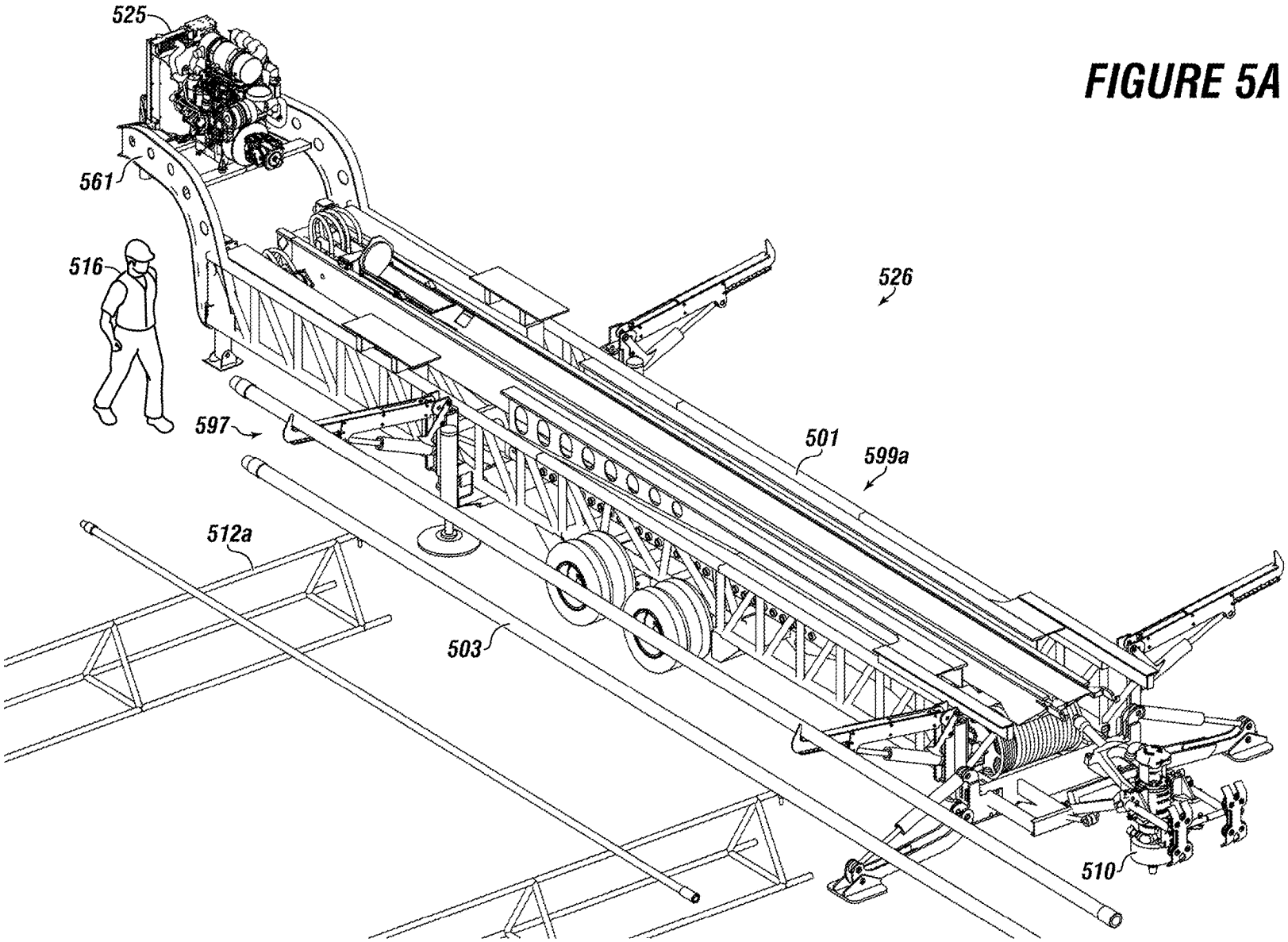
FIG. 5A shows an isometric front view of a working operation system using having a combination handling unit in a first position according to embodiments of the disclosure.

Referring now to FIGS. 5A-5E together, an isometric front view of a combination tubular and power swivel handling unit in a first position, an isometric front view of the combination unit of FIG. 5A in an intermediate position, an isometric front view of the combination unit of FIG. 5A having another intermediate position with an extended telescoping trough, an isometric front side view of the combination handling and transport unit of FIG. 5A in a delivery position where a tubular and a power swivel are presented to a rig floor, and an isometric front view of a power swivel of a drill rig coupled with a tubular delivered to the drill rig from a combination unit, illustrative of embodiments disclosed herein, are shown.

FIGS. 5A-5E show a drilling operation or system 500 having the combination tubular and power swivel handling unit 501. While referred to as 'drilling', the working operation or system 500 is not meant to be limited, as there are a number of instances and operations where the unit 501 may be used.

The combination unit 501 may be operated or otherwise used in a manner to provide, control, facilitate, etc. handling and transport of one or more components. In embodiments, the unit 501 may provide delivery of either a tubular 503 or a power swivel 510 to a rig or derrick 502. While it need not be exactly the same, the unit 501 may be assembled, run, and operated as described herein and in other embodiments (such as for unit 201, and so forth), and as otherwise understood to one of skill in the art.

Components of the unit 501 may be arranged by, disposed on, or otherwise coupled with a trailer or support frame 513, and as otherwise understood to one of skill in the art. Thus, the unit 501 may be comparable or identical in aspects, function, operation, components, etc. as that of other unit embodiments disclosed herein (e.g., 201). Similarities may not be discussed for the sake of brevity.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the unit 501 for operation thereof. For example, a pump (with engine) 525 may be in fluid communication with one or more sources, such as a fluid tank, with the unit 501 (or its components) being in fluid communication with a discharge of the pump (such as via a manifold, piping, tubing, etc.). All components of the unit 501 requiring power or automation may be provided with wiring, tubing, piping, etc. in order to be operable therefore.

The unit 501 may be used with and part of the drilling system 500. As such, the system 500 may include the derrick 502 configured with suitable components to rotate a drill string 504. The drill string 504 may be rotated with the driver 510, typically a top drive or power swivel type mechanism (with associated elevator, drive frame, drawworks, etc.).

The unit 501 may be positioned proximate the derrick 502, whereby the unit 501 may be operated in manner to deliver one or more tubulars 503*a* and other equipment (such as driver 510) to and from a rig floor or working platform 515. The plurality of tubulars 503*a* may be transferred to and from a tubular source 512 via the unit 501 (typically one at a time). The tubular source 512 may include a pipe rack 512*a* having the plurality of tubulars 503*a* thereon. The unit 501 may have a transfer mechanism 597 to accommodate the transfer of the tubular 503 to and from the unit 501.

To any extent embodiments herein are described for the transfer of tubulars and equipment to the derrick 502, one of skill would appreciate that as a job or operation is finished or otherwise at a stopping point, the tubulars 503*a* may be removed (e.g., from the wellbore) in a similar albeit opposite manner, and thus the unit 501 operable to transfer tubulars 503*a* back to the source 512 and the power swivel 510 back to a support rack 551. Accordingly, the unit 501 may be configured with a mechanism or kicker (not shown here) to initiate transfer of tubulars 503*a* therefrom.

The support rack 551 may be movingly coupled with the support frame 513, and also operably engaged with a power source (such as a hydraulically movable piston/rod). Thus, the support rack 551 may be moved from a first or lowered position to a second or raised position. In embodiments, the first position may have an angle of rotation of 45 degrees to 120 degrees from the second position.

The transfer mechanism 597 may include a plurality of tubular handling arms 530 *a,b*. The tubular handling arms 530 *a,b* may be movingly coupled with the support frame 513, and also operably engaged with a power source (such as a hydraulically movable piston/rod). The handling arms 530 *a,b* may be positional to have a (slight) grade one way or another to allow the tubular(s) 503 to roll toward or away from a trough assembly 598, as may be applicable.

The trough assembly 598 may include a soft low torque pipe grabber to hold pipe against spinup torque of a power swivel if so used.

The unit 501 may be configured with one or more movable outriggers, extensions, legs etc. 519 coupled with the support 513, which may help secure or hold the unit 501 in a substantially immovable fashion.

The combination unit 501 may have the power swivel 510 movingly disposed thereon. That is, the power swivel 510 may be positioned within the power swivel support or rack 551. One or more components operatively associated (and connected, directly or indirectly) with the power swivel 510 may include any of a hose reel 527, a fluid tank(s) (not shown here), and a pump and engine 525. There may be one or more hoses 556 coupled between the power swivel 510 and the hose reel 527. The hose reel 527 may be configured with an amount of tension to aid or facilitate rolling up and unrolling of the hoses 556. Any or all of the hoses 556 may be of sufficient length to accommodate moving the power swivel 510 to a height h.

Figure 6A:
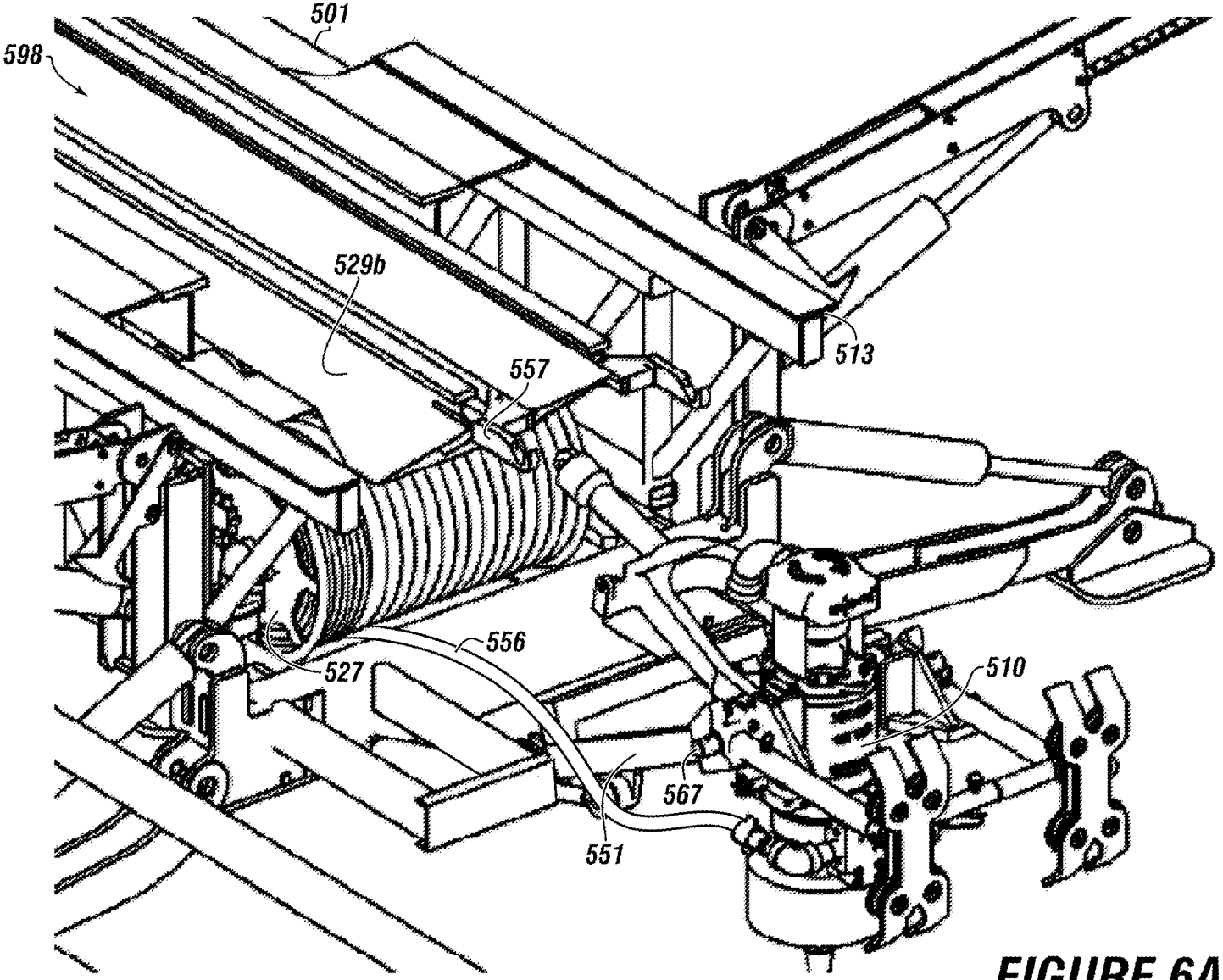
FIG. 6A shows a close-up isometric view of a power swivel disposed on a support rack of a combination handling unit according to embodiments of the disclosure.
Figure 6B:
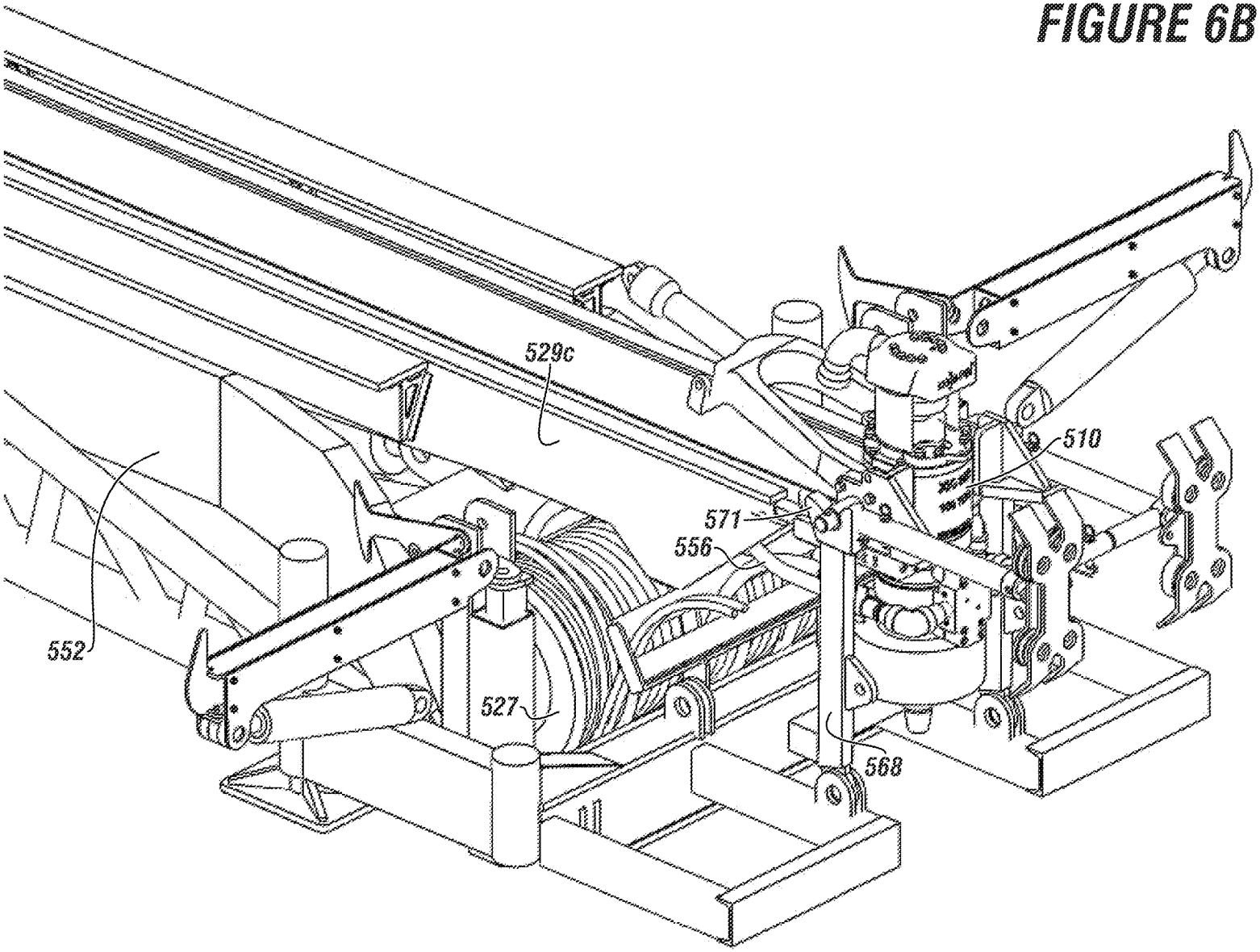
FIG. 6B shows close-up isometric view of the support rack moved to a raised position according to embodiments of the disclosure.
Figure 6C:
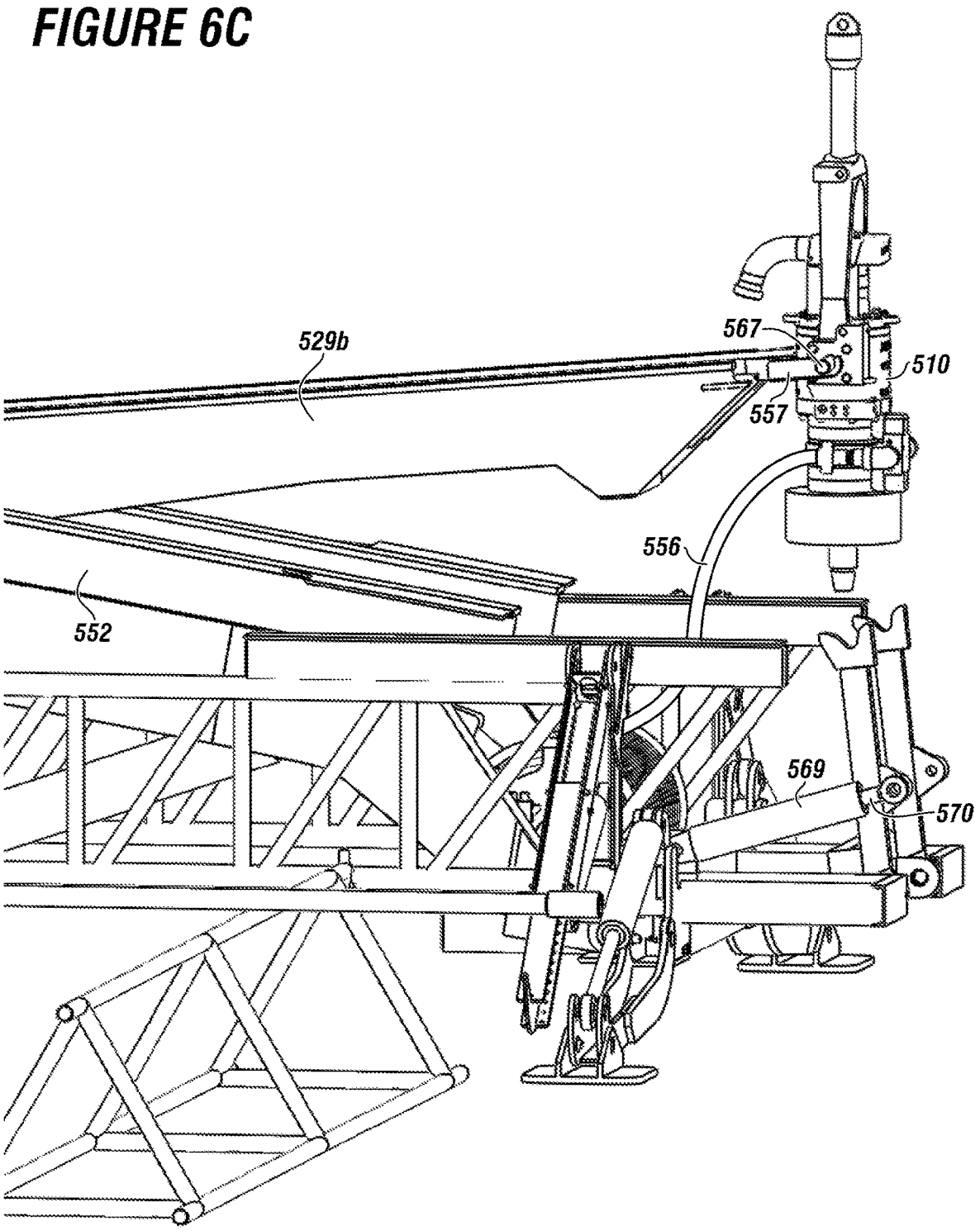
FIG. 6C shows a close-up side view of the power swivel lifted off the support rack according to embodiments of the disclosure.

Referring briefly to FIGS. 6A, 6B, and 6C together, a close-up isometric view of a power swivel disposed on a support rack of a combination unit, a close-up isometric view of the support rack moved to a raised position, and a close-up side view of the power swivel lifted off the support rack, illustrative of embodiments disclosed herein, are shown.

FIGS. 6A-6C together show a combination tubular and power swivel handler unit 501 may have a support frame 513 with one or more components coupled therewith, including movingly. For example, the combination unit 501 may have a trough assembly 598 (associated with a tubular handler) movingly coupled with the support frame 513. The combination unit 501 may also have a power swivel support rack 551 movingly coupled with the support frame 513. The power swivel support rack 551 may be movable from a first or lowered position (FIG. 6A) to a second or raised position (FIG. 6B).

There may be a hose reel 527 disposed on the unit 501. The hose reel may be disposed underneath an end 529*b* of the trough assembly 598. The hose reel 527 may have a set of hoses, such as one or more hoses 556. Any of the hoses 556 may be also coupled with the power swivel 510, such that the power swivel 510 may be in fluid communication with the hose reel 527, as well as a fluid source. The hose reel 527 may be configured for the hose 556 to readily unroll therefrom as the power swivel 510 is raised (and vice versa).

The support rack 551 may include one or more movable support rack arms 568. As shown here, there may be two support rack arms 568, each arm 568 being coupled with a respective powered (such as hydraulic) support rack piston/rod assembly 569. A rod 570 of the assembly 569 may be extendable/retractable therefrom corresponding to movement of the arm 568.

While not limited to any particular way of resting on the support rack 551, the power swivel 510 may have one or more support posts 567 extending therefrom. The support posts 567 may be configured to reside within a post receptacle 571 on the end of the support rack arm 568.

As the trough assembly 598 is raised by a raising leg 552, driver lifting hooks 557 may engage the support posts 567, and thus raise the power swivel from the support rack 551. The power swivel 510 may then be delivered to the derrick (502, FIG. 5E), including with hoses 556 coupled therewith. The unit 501 may accomplish in reverse the delivery of the power swivel 510 from the derrick to the support rack 551 (including with hoses 556 rolling up back around hose reel 527).

Returning again to FIGS. 5A-5E, the unit 501 may include an operator station 522. As the unit 501 may combine functionality, one of skill would appreciate that all operations associated with operating the tubular handler 526 (including operation of the trough assembly 598) and transfer mechanism 597, as well as operation of the power swivel 510 (including while on the derrick 502), may be accomplished by personnel 516 via the operator station 522, without need for other operator stations. The station 522 may be detachably secured to the support 513. Alternatively, a separate remote control panel placed on the rig floor for the rig operator's control of power swivel 510.

The tubular handler 526 and transfer mechanism 597 may be movingly secured to or otherwise coupled with the support frame 513. The transfer mechanism 597 may include an indexing mechanism (not viewable here) to index one tubular 503 (of a plurality of tubulars 503*a*) at a time into the trough assembly 598.

The trough assembly 598 may include a main trough 529. The trough assembly 598 may have a portion thereof (such as an end 529*a*) configured for lifting the power swivel 510 off the rack 551.

The trough assembly 598 may have a carrier trough 529*a* movingly engaged with the main lifting arm 529. For example, the trough 529*a* may be telescopingly movable with respect to the main lifting arm 529, thereby providing additional length to which the trough assembly 529 may reach. In embodiments, the trough 529*a* may extend between and including 0 feet and 50 feet out from the main trough 529.

Movement of the secondary trough 529*a* may be via a sprocket and chain mechanism, rollers, and so forth, which may be powered in a manner known to one of skill in the art. The trough 529*a* may have one or more lifting hooks 557 configured to lift the power swivel 510 from the rack 551 (and vice versa). The trough 529*a* may have soft low torque backup for the power swivel 510 (including while in a tilted position) into box connection of the tubular(s) 503.

Alternatively, a grabber function may be added to a power swivel to safely react the spinup torque applied by the power swivel.

Although not limited to any particular shape other than what might otherwise be suitable to hold the tubular 503, either of the troughs 529, 529*a* may be a general v-shaped structure (in lateral cross-section), which may be useful to center the tubular 503. The trough assembly 598 may have a pusher or skate 532 operatively and movingly associated therewith. As such, the skate 532 may be operable to push the tubular 503 (or a portion of either troughs 529, 529*a*) in order to present the tubular 503 to the rig floor 515 (or the proximate area of the system 500 to which the string 504 may be made up). As such, the skate 532 may be movable via a sprocket and chain mechanism, rollers, and so forth, which may be powered in a manner known to one of skill in the art.

Spinup function may be used for powered spinup of the tubular 503 onto the pin (or stem) of the power swivel or without rotating serve as a backup against the spinup torque supplied by the power swivel.

The skate 532 may be part of an assembly configured to include a spin-up function. Accordingly there may be a device hinged atop a skate frame arranged with one or more jaw protrusions attached to a body allowing vertical motion within the "vertical center plane" of the trough such that when a connected actuator urges the body down upon a tubular so delivered to the trough center plane by a pipe handling system, said jaw protrusions on either side of said tubular, arranged to fit or hydraulically adjustable to fit the OD of various sized tubulars, will clamp on said tubular to provide a "backup" or reactive/resisting torque when said tubular is rotated by a powered rotating device such as a power swivel or hydraulic pipe wrench when said powered rotary device is used to apply a low spinup torque to a threaded connection of a tubular laying in a trough.

The tubular handler 526 may be configured with a mechanism or other suitable configuration to lift the trough assembly 598 (including an end of the trough 529*c*) to present or bring the tubular 503 to the drilling rig 502. As shown here, there may be a raising leg 552 movingly (such as slidingly) coupled with the trough 529. The raising leg 552 may be powered by a raising leg piston 596. As the raising leg piston 596 is powered, a raising leg piston rod 596*a* may extend therefrom and raise the raising leg 552, which results in raising of the trough 529.

Figure 5B:
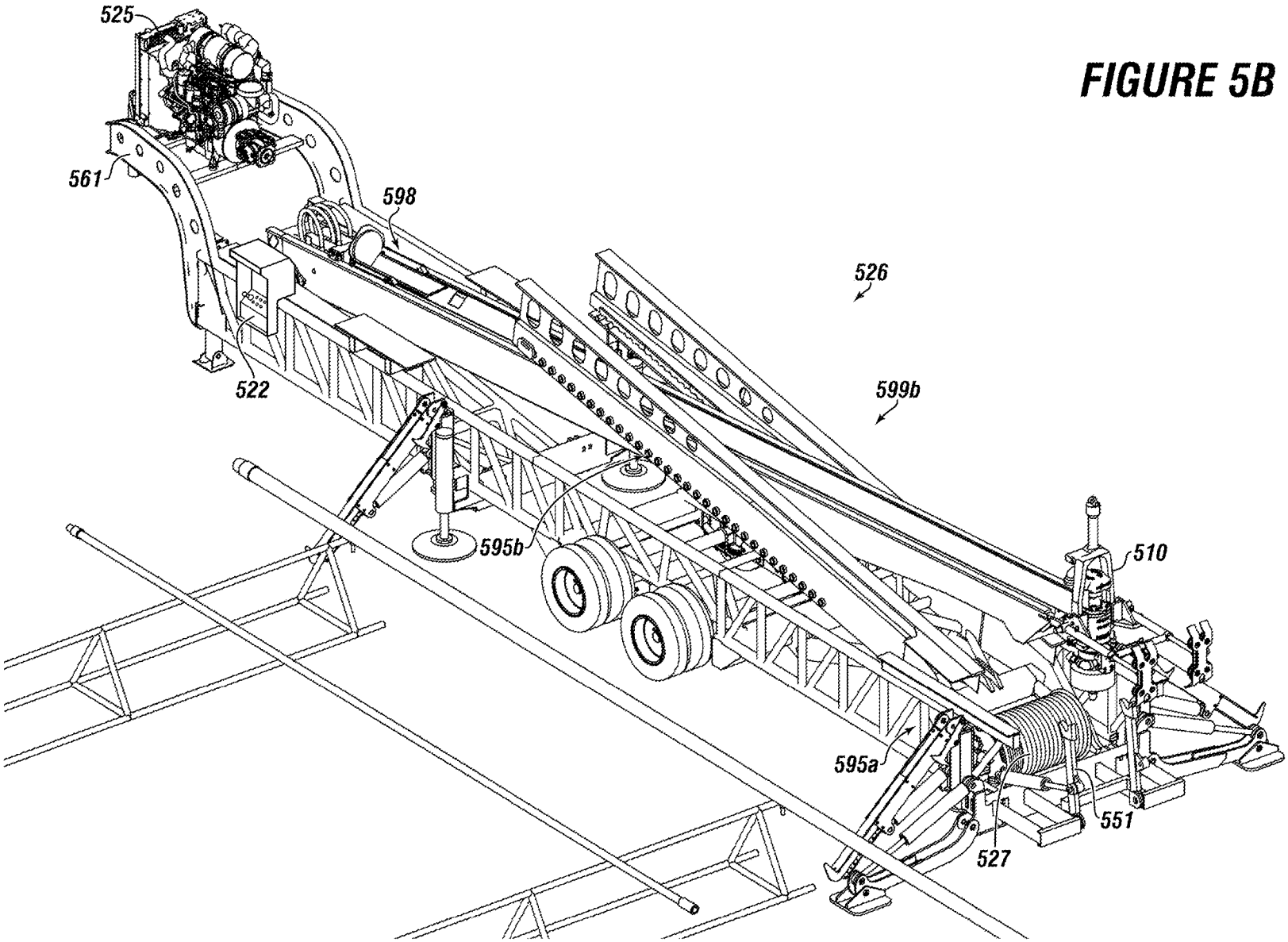
FIG. 5B shows an isometric front view of the combination handling unit of FIG. 5A in an intermediate position according to embodiments of the disclosure.
Figure 5C:
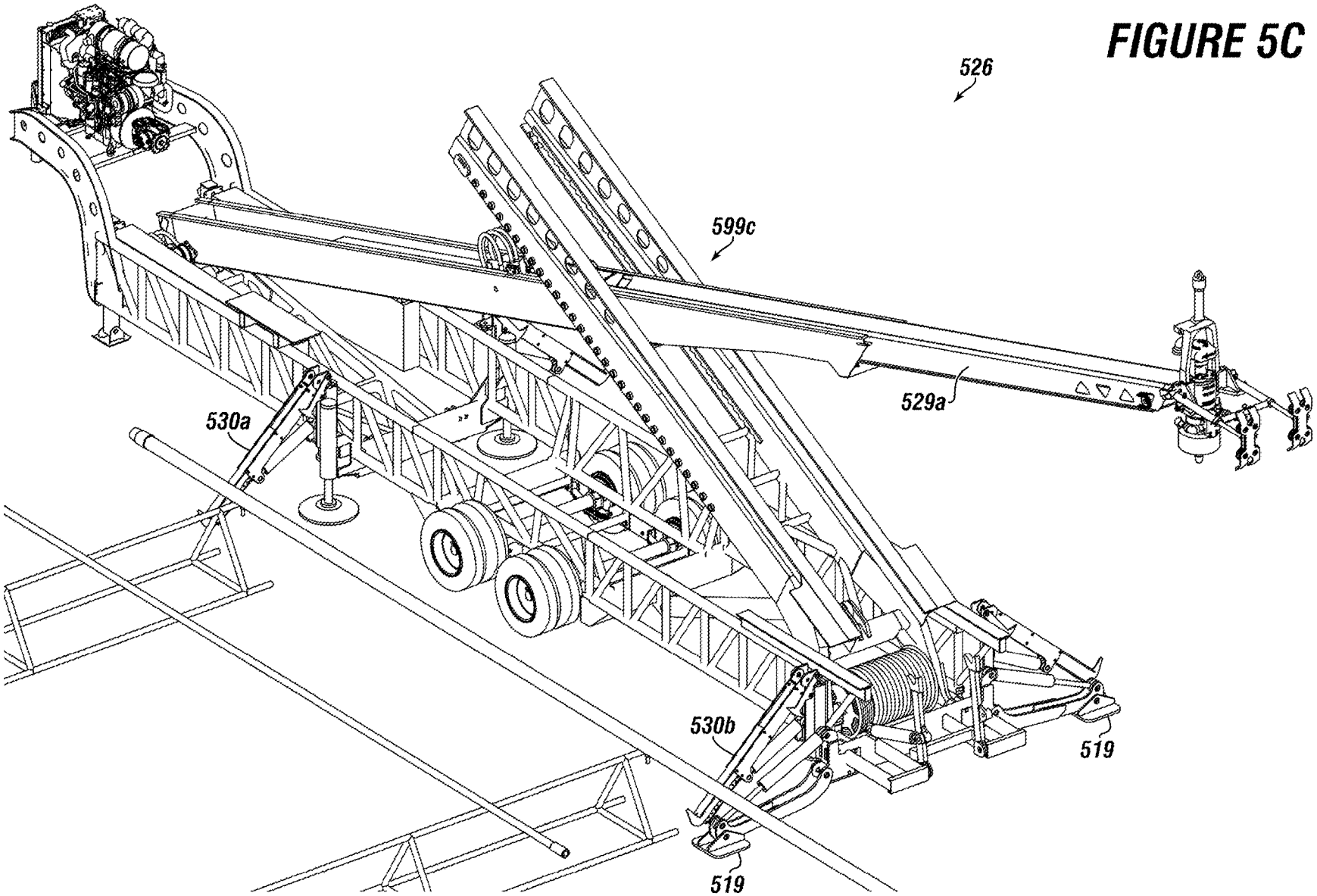
FIG. 5C shows an isometric front view of the combination handling unit of FIG. 5A having another intermediate position with an extended telescoping trough according to embodiments of the disclosure.
Figure 5D:
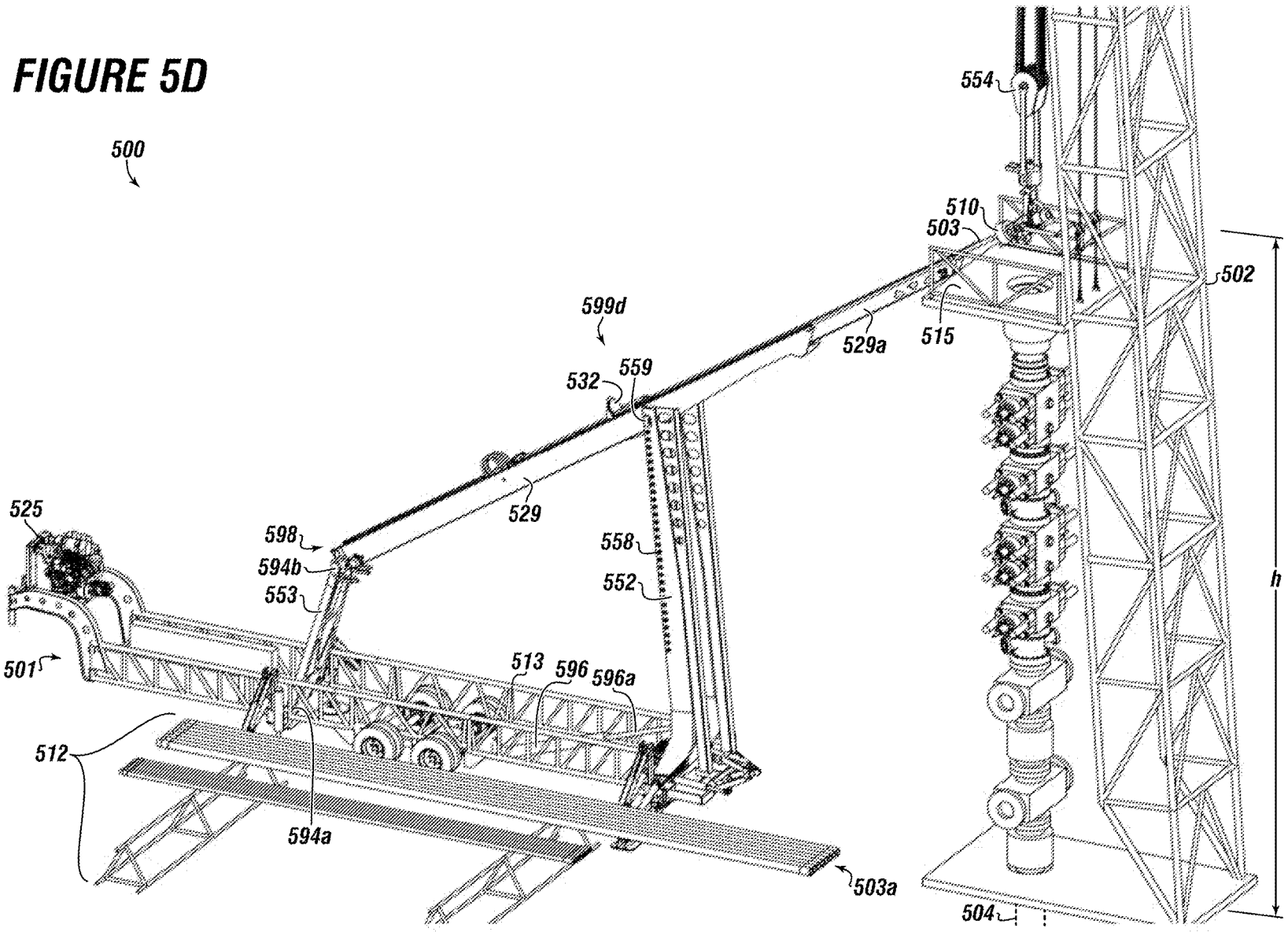
FIG. 5D shows an isometric front side view of the combination handling unit of FIG. 5A in a delivery position where a tubular and a power swivel are presented to a rig floor according to embodiments of the disclosure.

FIG. 5A shows the trough assembly 598 in a first or lowered position 599*a*, where the piston rod 596*a* is retracted; FIGS. 5B and 5C show the trough assembly 598 in a raised intermediate position(s) 599*b*, 599*c*; FIG. 5D shows the trough assembly 598 in a delivery position 599*d*. It would be appreciated that the delivery position 599*d* need not include the trough 529 moved to its highest position and/or the secondary trough 529*a* extended therefrom. Thus, the delivery position 599*d* may be tantamount to that of any intermediate position of the trough/trough assembly 529/598.

The raising leg 552 may be movingly (e.g., pivotably) coupled with the support frame 513, such as seen at first leg connection point 595*a*. The raising leg 552 may be movingly (e.g., slidingly) coupled with the trough 529, such as seen at second leg connection point 595*b*. A plurality of connection points are possible, whereby the raising leg 552 may be coupled with the frame support 513 at two or more points and/or may be coupled with the trough 529 at two or more points.

Figure 7A:
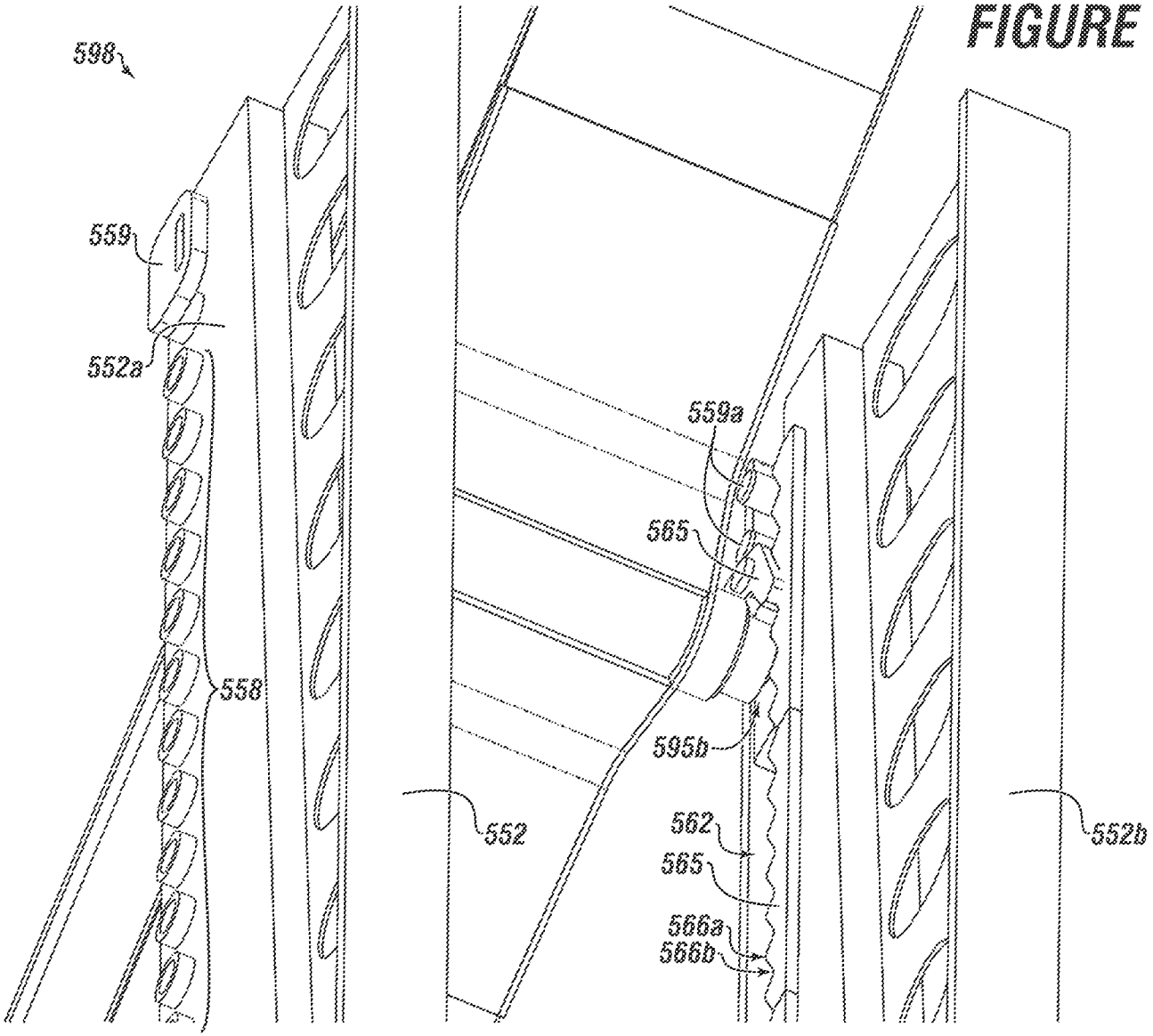
FIG. 7A shows an underside view of a trough assembly coupled with a raising leg according to embodiments of the disclosure.
Figure 7B:
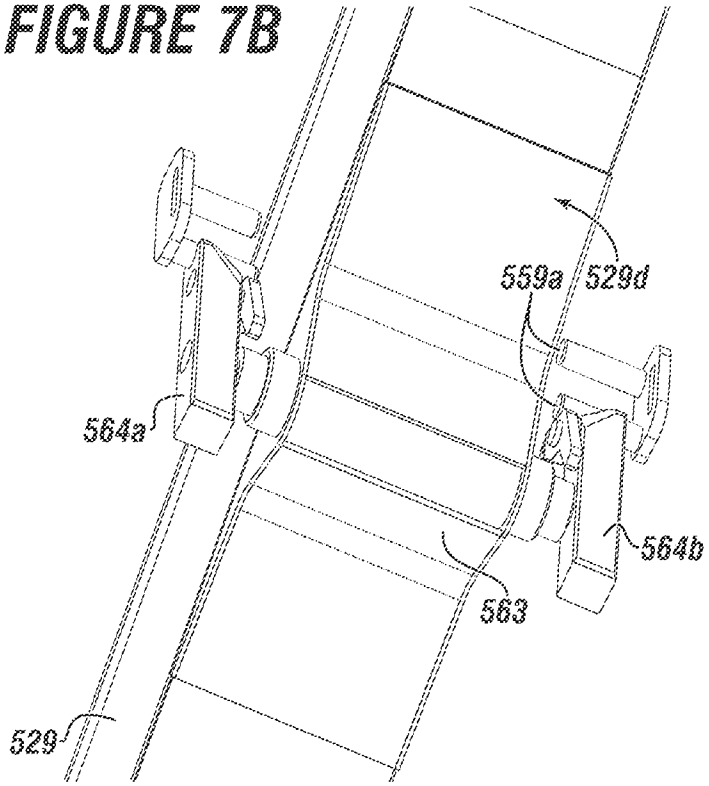
FIG. 7B shows underside view of the trough assembly of FIG. 7A according to embodiments of the disclosure.

Referring briefly to FIGS. 7A and 7B together, an underside view of a trough assembly coupled with a raising leg, and an underside view of the trough assembly, in accordance with embodiments herein, are shown.

FIGS. 7A and 7B show The trough assembly 598 may have a portion thereof coupled with a raising leg 552. As shown in the figures, an underside 529*d* of the trough 529 may have a trough housing 563. From the trough housing 563, there may be an at least one bullet slider 564*a* (or just 'slider') extending therefrom. In embodiments, there may be a first slider 564*a* and a second slider 564*b*. While not limited to any particular shape, the sliders 564 *a,b* may be configured to slidingly engage within a guide rail(s) 562 of the raising leg 552.

As shown, the raising leg 552 may slidingly engage with the trough assembly 598 on a first leg side 552*a* and a second leg side 552*b*.

Each of the sides 552 *a,b* may be configured with respective guide rails 562. The guide rail 562 may be configured with a ratchet structure 566, which may include alternating crest 566*a* and trough 566*b* structure. A locking dog 565 may be configured to navigate or move through the ratchet 566 in a first direction over each adjacent crest/trough, but is locked from moving in the opposite direction. It follows that the raising leg 552 and trough assembly 598 may slidingly move with respect to each other in the first direction, but may not in the opposite direction (unless and until the locking dog 565 is released/moved).

The locking dog 565 may be or include an assembly having have a spring-loaded (Rod-side) hydraulic cylinder that with pressure, which may be suitable to overcome a spring force and release the dog from engagement with the ratchet structure 566.

For example, extension of a cylinder by hydraulic pressure may release the dog 565. As such, loss of pressure may allow a rod-side spring to retract a cylinder and engage the latch on any crest/trough of the ratchet 566 (not shown here).

In embodiments dog 565 (or assembly) may include a dog-latch upper extension in contact with the selector pin 559, which by initial contact force may engage the dog 565 just before the slider(s) contacted the pin 559.

Any of the raising leg sides 552 *a,b* may also be configured with a set or row of selector pin holes 558. An end 559*a* of a selector pin(s) 559 may be pushed or otherwise disposed through the pin holes 558. The end 559*a* may be of suitable shape, length, etc. to be a mechanical stop to the respective slider 564 *a,b* (see partial view of FIG. 6B) at connection point 595*b*.

Returning again to FIGS. 5A-5E, once the sliders (564 *a,b*, FIG. 6A) hit a selector pin 559 (disposed within an least one hole of a row of selector holes 558), the raising leg 552 may continue to lift the trough 529, as well as following leg 553. While not meant to be limited, the raising leg 552 may have a raising leg range of motion in a range of about 0 degrees (generally FIG. 5A) to about 130 degrees (generally FIG. 5D) with respect to a horizontal axis 555*b*. The raising leg 552 may be moved to a raising leg angle in a suitable manner whereby the trough assembly 598 may reach the rig floor 515 at a height h. The height h may be in a height range of about 5 feet to about 100 feet.

The position of the selector pin 559 may be readily and easily changed to accommodate different elevation requirements. The position of the selector pin 559 may be changed while the tubular handler 526 is in the lowered or first position.

The tubular handler 526 may also or alternatively include a mechanism to lift the trough 529 (or end 529*b*) in order to adjust an angle of presentation of the tubular 503. Thus, the angle of presentation may vary (compare elevation of end 529*b* in FIG. 5A to FIG. 5D).

Figure 5E:
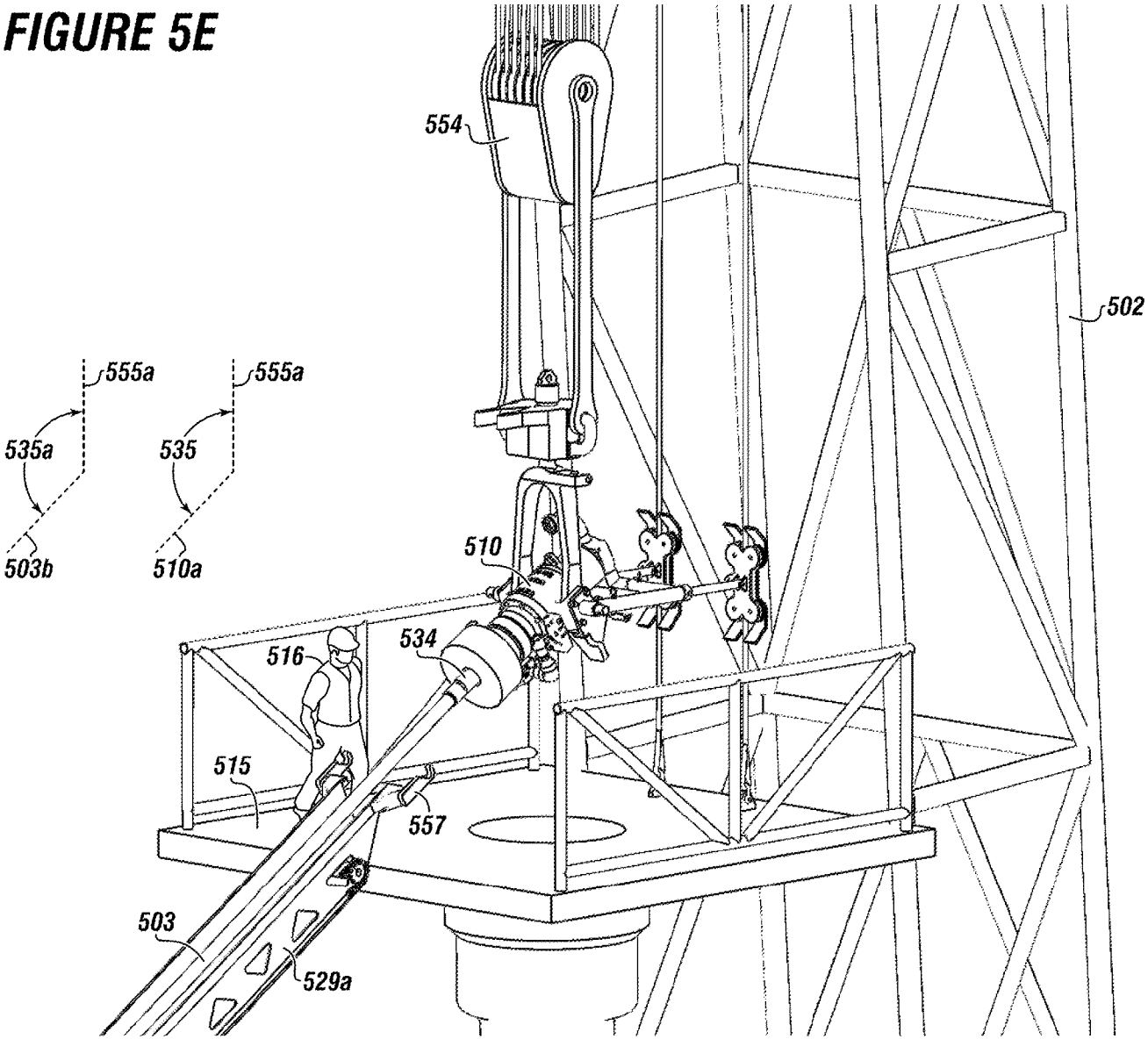
FIG. 5E shows an isometric view of the combination handling and transport unit of FIG. 5A in a delivery position where a power swivel is engaged with a tubular on the unit according to embodiments of the disclosure.

An angle of presentation 535*a* of the tubular 503 may be substantially parallel to a tilt angle 535 of the driver 510. FIG. 5E illustrates the driver 510 coupled with a travelling block 554 (of a derrick 502) may have a driver axis 510*a*. As a driver stem 534 of the driver 510 may be tilted, the driver stem 534 may be presented at the driver tilt angle 535 (such as with reference to a vertical axis 555*a*) for mating with a tubular 503.

In a similar manner, the tubular 503 may have a (longitudinal) axis 503*b*. The tubular may be presented (delivered) via the trough assembly 529 to personnel 516 on a rig floor 515 of the derrick 502. The tubular 503 may be presented with the angle of presentation of the tubular 535*a*. While it need not be exact, the driver angle 535 and the angle of presentation 535*a* may be (substantially) parallel.

The following leg 553 may have movingly (e.g., pivotably) coupled with the support frame 513, such as seen at first following leg connection point 594*a*. The following leg 553 may be movingly (e.g., pivotably) coupled with the trough 529, such as seen at second following leg connection point 594*b*. A plurality of connection points are possible, whereby the following leg 553 may be coupled with the frame support 513 at two or more points and/or may be coupled with the trough 529 at two or more points (such as on each side of the following leg 553).

While not meant to be limited, the following leg 553 may have a following leg range of motion in a range of about 0 degrees (generally FIG. 5A) to about 130 degrees (generally FIG. 5D) with respect to the horizontal axis 555*b*. The following leg 553 may be moved to a following leg angle in a suitable manner whereby the trough assembly 598 may reach the rig floor 515 at the height h, and also the desired presentation angle may be achieved.

Once delivered, the driver 510 may be operatively attached to a traveling block or other suitable component(s) 554 of the rig 502. The pusher or skate 532 may extend or otherwise move the tubular 503 and present it to the rig 502. The driver 510 may have a stem 534 for threadably engaging the tubular 503. The traveling block 554 of the rig 502 may then be raised to lift the tubular 503. When presented to the rig 502 (or rig floor 505), the tubular 503 may be engaged (e.g., threadingly) by the driver 510, lifted off the trough 529, and then moved to a vertical position for engagement (making up) with another tubular (not shown here).

Advantages

Embodiments of a combination pipe handling and power swivel unit provide for a unique tubular handling unit that brings many benefits including safety, speed, and economic benefit.

This unit may be height adjustable without dangerous pinning, and may reach rig floors as high as forty feet without an extension. For spin up, a power swivel may automatically move to a same preset angle as the tubular laying in handler. Spin up torque may be backed up by a soft hydraulic tubular backup device.

Alternatively, if power swivel rotation is not desired by customer, the pipe handler may provide pipe rotation onto the pin of the non-rotating power swivel.

The unit may safely move the power swivel (or other tools, devices, components, etc.) to and from a rig floor, without the need for winching. The unit may move a control panel and control umbilical to personnel on the rig floor. Therefore, the need for climbing stairs and man-carrying a panel is mitigated or eliminated. When the power swivel is not in use, it may move to an out of the way park position.

Embodiments herein may reduce liability up to 50% by eliminating the need for additional personnel, as only one driver, truck, trailer, etc. need be used instead of two. And height adjustment required for various rig floor heights requires no dangerous pinning.

Other advantages herein may include less initial cost than separated, conventional pipe handler and power swivel units. Synergistically there may be less operating cost than two separate units (e.g., savings from labor, fuel, insurance, etc.), as well as less maintenance and storage cost than two separate units (only one trailer, engine, hydraulic system, etc.), space saving (only one footprint at rig site), and reduced environmental impact (one unit, one hydraulic system, one engine, etc.

Still other advantages include time savings, range of pipe length without extensions (tubular length capacity to 48'—no extension required), handling upwards of 2000 lb joints of pipe up to 5½" casing without adjustment, and flexible usage (service companies may offer either/both power swivel or tubular handling services with one unit).

Even a small savings in drilling or servicing time of individual wells results in an enormous savings on an annual basis.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A combination tubular handler and power swivel unit comprising:

a support frame;

a power swivel movingly disposed on the support frame;

a tubular handler coupled with the support frame, and comprising:

a trough assembly comprising:

a main trough having a first end configured for a secondary trough to extend therefrom; and a skate configured with a platform for resting an end of a tubular thereon;

a raising leg movingly coupled with the trough assembly, the raising leg configured with a first guide rail;

a following leg pivotably coupled with an end of the trough assembly; and a transport mechanism configured to facilitate transfer of an at least one tubular to the trough assembly;

wherein the trough assembly is configured to lift the power swivel for delivery of the power swivel or the tubular to a height, and wherein an underside of the main trough is configured with a trough housing.

2. The combination unit of claim 1, wherein the trough housing has a first side configured with a first slider extending therefrom, and a second side configured with a second slider extending therefrom.

3. The combination unit of claim 2, wherein the raising leg is configured with a second guide rail, wherein the first slider movingly engages with the first guide rail, and wherein the second slider movingly engages with the second guide rail.

4. The combination unit of claim 1, wherein the first guide rail is configured with a ratchet structure that comprises an alternating crest and trough structure, and wherein a locking dog is configured to navigate or move through the ratchet structure in a first direction over each adjacent crest/trough, but is locked from moving in the opposite direction.

5. The combination unit of claim 1, the unit further comprising:

a hose reel comprising a plurality of hoses; and a pump disposed on the support frame;

wherein the power swivel is in mechanical communication with the pump and the plurality of hoses, and wherein the height is in a height range between and including 20 feet to 100 feet.

6. The combination unit of claim 1, wherein the trough housing has a first slider coupled with a first housing side of the trough housing, and a second slider coupled with a second housing side of the trough housing, and wherein the raising leg comprises the first leg guide rail movingly engaged with the first slider, and a second leg guide rail movingly engaged with the second slider.

7. The combination unit of claim 1, wherein the raising leg is configured to move in a raising leg angle range between and including 0 degrees to 175 degrees, and wherein the combination unit further comprises an operator station operably configured to control an at least one of the tubular handler, the power swivel, and combinations thereof.

8. The combination unit of claim 7, the unit further comprising an at least one fluid source disposed on the support frame and in fluid communication with each of the pump and the power swivel.

9. A drilling system comprising:

a derrick comprising a rig floor elevated a height from ground level;

a tubular source proximate to the derrick, and comprising an at least one tubular;

a combination tubular handler and power swivel unit comprising:

a support frame;

a power swivel movingly disposed on the support frame;

a tubular handler coupled with the support frame, and comprising:

a trough assembly comprising:

a main trough having a first end configured for a secondary trough to extend therefrom; and a skate configured with a platform for resting an end of a tubular thereon;

a raising leg movingly coupled with the trough assembly, the raising leg configured with a first guide rail and a second guide rail;

a following leg pivotably coupled with an end of the trough assembly; and a transport mechanism configured to facilitate transfer of the at least one tubular to the trough assembly from the tubular source, wherein the trough assembly is configured to lift the power swivel off the power swivel support rack for delivery of the power swivel and the at least one tubular to the rig floor, and wherein an underside of the main trough is configured with a trough housing.

10. The drilling system of claim 9, the system further comprising:

a hose reel comprising a plurality of hoses; and a pump disposed on the support frame;

wherein the power swivel is in mechanical communication with the pump and the plurality of hoses, and wherein the height is in a height range between and including 20 feet to 100 feet.

11. The system of claim 9, wherein the main trough comprises a trough housing with a first slider coupled with a first housing side of the trough housing, and a second slider coupled with a second housing side of the trough housing, wherein the raising leg comprises the first leg guide rail movingly engaged with the first slider, and the second leg guide rail movingly engaged with the second slider.

12. The system of claim 11, wherein the trough assembly comprises a set of hooks configured to lift the power swivel from the support frame, and wherein the raising leg is configured to move in a raising leg angle range between and including 0 degrees to 120 degrees.

13. The system of claim 9, the unit further comprising an at least one fluid source disposed on the support frame and in fluid communication with each of a pump and the power swivel, and wherein the hose reel is disposed on the support frame and underneath the first end of the trough assembly when the trough assembly is in its lowered position.

14. The system of claim 13, wherein the support frame comprises a gooseneck, and wherein the pump is disposed on the gooseneck.

15. A combination handling unit for delivery of tubulars and a power swivel comprising:

a support frame;

a power swivel movingly disposed on the support frame;

a tubular handler coupled with the support frame, and comprising:

a trough assembly comprising:

a main trough having a first end configured for a secondary trough to extend therefrom; and a skate configured with a platform for resting an end of a tubular thereon;

a raising leg movingly coupled with the trough assembly, the raising leg configured with a first guide rail and a second guide rail;

a following leg pivotably coupled with an end of the trough assembly; and a transport mechanism configured to facilitate transfer of an at least one tubular to the trough assembly;

wherein the trough assembly is configured to lift the power swivel for delivery of the power swivel or the tubular to a height, wherein the main trough comprises a trough housing with a first slider coupled with a first housing side of the trough housing, and a second slider coupled with a second housing side of the trough housing.

16. The combination unit of claim 15, wherein the raising leg comprises the first guide rail movingly engaged with the first slider, and the second guide rail movingly engaged with the second slider.

17. The system of claim 16, wherein the trough assembly comprises a set of hooks configured to lift the power swivel from the support frame, and wherein the raising leg is configured to move in a raising leg angle range between and including 0 degrees to 120 degrees.

18. The combination unit of claim 17, wherein the first guide rail is configured with a ratchet structure that comprises an alternating crest and trough structure, and wherein a locking dog is configured to navigate or move through the ratchet structure in a first direction over each adjacent crest/trough, but is locked from moving in the opposite direction.

* * * * *